US006449910B1

(12) United States Patent
Budd

(10) Patent No.: US 6,449,910 B1
(45) Date of Patent: Sep. 17, 2002

(54) ROOF DRIP EDGE CONSTRUCTION, CORNER ASSEMBLIES THEREFOR AND METHODS OF MAKING SAME

(76) Inventor: Calvin M. Budd, 1244 Mills Rd., Ozark, MO (US) 65721

( * ) Notice: Subject to any disclaimer, the term of this patent is extended or adjusted under 35 U.S.C. 154(b) by 72 days.

(21) Appl. No.: 09/589,979

(22) Filed: Jun. 8, 2000

Related U.S. Application Data

(63) Continuation-in-part of application No. 09/181,503, filed on Oct. 28, 1998, now Pat. No. 6,073,400.

(51) Int. Cl.[7] ..... E04D 13/15
(52) U.S. Cl. ..... 52/58; 52/94; 52/96; 52/302.6
(58) Field of Search ..... 52/58, 60, 61, 52/62, 94, 96, 97, 302.6, 658, 716.2, 717.06

(56) References Cited

U.S. PATENT DOCUMENTS 1,480,246 A * 1/1924 Douglas ..... 52/94
2,255,279 A * 9/1941 Callaway ..... 52/61
2,592,482 A * 4/1952 Sperry ..... 52/94 X
2,822,763 A * 2/1958 Berg ..... 52/60
2,857,861 A * 10/1958 Trostle ..... 52/94
3,012,376 A * 12/1961 Reddy et al. ..... 52/96
3,093,931 A * 6/1963 Waring ..... 52/96
3,181,275 A 5/1965 Schroter et al.
3,199,256 A * 8/1965 Considder ..... 52/60 X
4,489,532 A 12/1984 Ellis et al.
4,741,132 A 5/1988 Emblin
4,890,426 A 1/1990 Hickman et al.
4,969,250 A 11/1990 Hickman et al.
5,065,553 A * 11/1991 Magid ..... 52/58
5,189,853 A * 3/1993 Braine et al. ..... 52/96
5,251,411 A * 10/1993 Kelley et al. ..... 52/60
5,515,653 A 5/1996 Smart
5,706,611 A * 1/1998 Attaway et al. ..... 52/60
5,884,435 A * 3/1999 David et al. ..... 52/62
6,073,400 A * 6/2000 Balisle et al. ..... 52/58

* cited by examiner

*Primary Examiner*—Laura A. Callo
(74) *Attorney, Agent, or Firm*—Richard L. Marsh

(57) ABSTRACT

An improvement in a pitched hip roof construction of a building construction is provided wherein the building construction has at least four wall sections, the roof construction comprising roof decking portions joined at at least the exterior hip junctures thereof, the outer edge of the roof construction overhanging the walls of the building construction and comprising in a roof edge plate affixed to the ends of roof rafters which are adapted to support the decking portions and the subsequent exterior roofing materials. The improvement in the roof construction further comprises having a roof drip edge applied over the terminal end of the decking portions and the roof edge plate, wherein the end of each juncture has means for covering affixed thereto prior to applying the exterior roofing materials.

20 Claims, 8 Drawing Sheets

75
72
14
13
96
85
80
95
98
73
52
77
99
79
71
76
11
171
56
73
86
74

70
50
60
87
53
94
63
97
66
51
67
64
57
54
14
11
161
61
13
62
65

ROOF DRIP EDGE CONSTRUCTION, CORNER ASSEMBLIES THEREFOR AND METHODS OF MAKING SAME

CROSS REFERENCE TO RELATED APPLICATIONS

This invention is a continuation-in-part application of its parent application Ser. No. 09/181,503, filed on Oct. 28, 1998, now U.S. Pat. No. 6,073,400 issued on Jun. 13, 2000.

BACKGROUND OF THE INVENTION

1. Field of the Invention

This invention relates to a roof drip edge assembly for a pitched roof and particularly for fabricated corner assemblies for valley corners and hip corners.

2. Prior Art Statement

It is known to provide a soffit construction which snaps into place under the eave of a roof having the outer edge jaw structure depending from the roof edge plate and attached thereto behind a conventional drip edge. For instance, see the U.S. Pat. No. 3,181,275 issued on May 4, 1965, to Schroter, et al.

It is also known to provide a metallic roof structure, one piece thereof comprising a drip edge with an interlocking channel for receiving the first shingle therein and further comprising a metallic valley base having the edges of shingles from adjoining roof portions bent into a channel in the valley base with a sealant placed into the junction of the adjoining shingles. For instance, see the U.S. Pat. No. 4,489,532 issued on Dec. 25, 1984 to Ellis, et al.

It is further known to provide elbow flashing sections at the corners of the building parapet for a built-up roof structure. For instance, see U.S. Pat. No. 4,741,132 issued on May 3, 1988 to Robert T. Emblin.

Additionally, it is known to provide corner elements for the corners of the building parapet for a built-up roof structure made of three pieces joined together by interlocking discontinuities along cooperating flanges and further including overlapping angled corners for a raised roof. In order to avoid leaving an unsightly opening or gap in the lower lip or drip edge mentioned above, the inventors provide an insert member adapted to be inserted into the opening in order to substantially fill the opening upon completion of the fabrication operations. For instance, see U.S. Pat. No. 4,890,426 issued on Jan. 2, 1990 and U.S. Pat. No. 4,969,250 issued on Nov. 13, 1990 both to Hickman, et al.

Finally, it is known in the art to provide a starter corner for a roof construction wherein the starter corner comprises two separate "L" shaped sections of metal wherein one section underlies the other section and has flap members folded upwardly and over flanges of the one section, the flap members press fitted onto the one section for securement thereto. For instance, see U.S. Pat. No. 5,515,653 issued on May 14, 1996 to Wayne G. Smart.

SUMMARY OF THE INVENTION

Although a drip edge is provided in the prior art, a suitable means of joining drip edge portions at an exterior juncture or an interior juncture of the roof decking, commonly referred to as hip corners and valley corners, respectively, is not available. Conventional practice is to nip off the ends of the drip edge with metal shears near the corner of the roof as the drip edge will be obscured by the guttering. As such, in the interest of saving time, the construction worker takes little care in nipping off the drip edge and thus the hip corner may have a gap of up to two inches between the ends of adjoining drip edge portions. Similarly, a valley corner may have the ends of the drip edge cut substantially square with the drip edge flange abutted in the corner but with a wedge shaped discontinuity at the valley base. In either case, although these gaps or discontinuities are typically filled with roofing cement or a plasticized mastic, water may still flow off the edge of the roof and travel behind the drip edge at these discontinuites casing alternating wetting and drying of the roof edge plate, the rafters and the roof decking thereby ultimately resulting in dry rot of these timbers. Furthermore, with different pitches of the roof of various building constructions, cutting of the drip edge to make a precise mitered corner for each pitch is different, therefore building construction workers do not attempt to make a valley or hip corner when applying drip edge to the roof edge.

Hence, a great need exists for pre-made fabricated corner assemblies for the drip edge of a pitched roof in a building construction that can be quickly placed in position, affixed to the roof decking or roof edge plate and thereafter overlapped at both ends with elongated straight sections of drip edge extending away therefrom along the roof edge plate. A further need exists for pre-made fabricated corner assemblies which may be utilized on various roof pitches. Yet another need is to manufacture fabricated corner assemblies from existing drip edge with a minimum of waste material.

Therefore it is an object of this invention to provide fabricated corner assemblies for the drip edge of a pitched roof in a building construction, each fabricated corner assembly comprising one elongated portion of drip edge miter cut on at least one end thereof and one elongated portion of drip edge straight cut on at least one end thereof one end of the straight cut portion adapted to bent to underlie one end of the miter cut portion of the drip edge and be fixedly retained thereto to form the fabricated corner assembly.

It is yet another object of this invention to provide fabricated corner assemblies for a valley corner of a pitched roof construction.

It is yet another object of this invention to provide fabricated corner assemblies for a hip corner of a pitched roof construction.

Another feature of this invention is to provide a fabricated hip corner assembly cut from a single sheet of material and folded into the hip corner assembly wherein the hip corner assembly has a continuous drip flange.

Another feature of this invention is to provide a fabricated hip corner assembly cut from a single sheet of material and folded into the hip corner assembly wherein the hip corner assembly has a continuous roof flange.

It is another object of this invention to provide fabricated corner assemblies for the drip edge of the differing pitched roofs of various building constructions.

Yet another object of this invention is to provide a fabricated corner assembly having the bent end of the roof engaging portion of the one end of the straight cut portion underlying the miter cut roof engaging flange portion of the one end of the miter cut portion.

Still another object of this invention is to provide a fabricated corner assembly having the bent end of the drip flange portion of the one end of the straight cut portion underlying the miter cut Up flange portion of the one end of the miter cut portion.

DESCRIPTION OF THE PREFERRED EMBODIMENTS

While the various features of this invention are hereinafter described and illustrated as fabricated corner assemblies for the drip edge of a pitched roof in a building construction, wherein each fabricated corner assembly comprises one elongated portion of drip edge miter cut on at least one end thereof and one elongated portion of drip edge straight cut on at least one end thereof and wherein one end of the straight cut portion is bent to underlie the miter cut portion of the drip edge and be fixedly retained thereto to form the fabricated corner assembly, it is to be understood that the various features of this invention can be used singly or in various combinations thereof to provide other fabricated corner assemblies for the drip edge of a pitched roof in a building construction as can hereinafter be appreciated from a reading of the following description. Specifically, a hip corner may be laid out upon a flat sheet of material, cut therefrom and folded into a fabricated hip corner assembly wherein the fabricated hip corner assembly has a continuous roof flange with a bent tab portion underlying a portion of the drip flange or a continuous drip flange with a bent tab portion underlying a portion of the roof flange.

Figure 1:
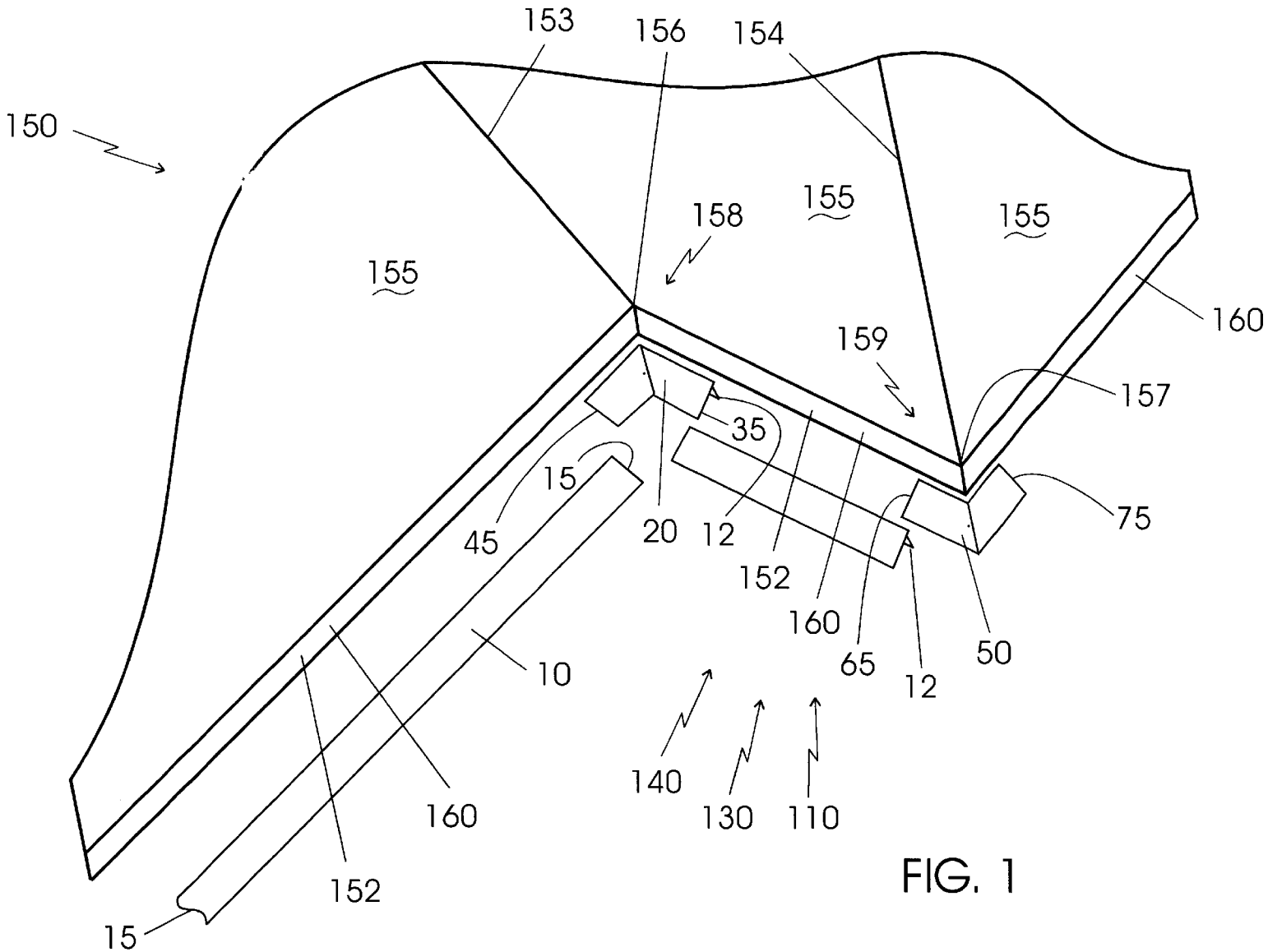
FIG. 1 is a partial perspective view of a roofing construction showing the preferred embodiment the corner assemblies of this invention ready to be installed thereon.

Referring to FIG. 1, a pitched hip roof construction 150 of a building construction having at least four wall sections typically comprises roof decking portions 155 joined at exterior hip junctures 154. The pitched hip roof construction 150 of FIG. 1 further has at least one valley juncture 153 adjacent two of roof decking portions 155 and thus the pitched hip roof construction 150 of FIG. 1 comprises roof decking portions 155 joined at at least one interior valley juncture 153 and at at least one exterior hip juncture 154. The outer edge 160 of roof construction 150 overhangs the walls of the building construction and has a roof edge plate 152 affixed to the ends of the rafters (not shown) which support the decking portions 155 and the subsequent roofing exterior materials (not shown). Prior to applying the subsequent roofing exterior materials, ie., roofing paper and the final shingling, roof construction 150 further has a roof drip edge 10 formed from elongated straight sections 111 of thin material having a T-shaped cross section, shown adjacent two portions of roof edge plates 152, applied over the terminal end of the decking portions 155 and the roof edge plate 152. As hereinbefore mentioned, and as can be readily appreciated by those skilled in pitched roof constructions, the ends 15 of roof drip edge 10 are usually nipped off with hand held metal shears in such a fashion that ends 15 generally do not meet or overlap along the cut ends 15 thereof at either the end 156 of valley juncture 153 or the end 157 of hip juncture 154 and therefore a gap exists between the ends 15 of adjoining sections of drip edge 10. This does not occur along the elongated sections of roof edge plate 152 as the straight sections 111 of drip edge 10 are overlapped at the ends 15 thereof Therefore, there is no problem with flow of fluids such as water seepage into the roof construction 150 along elongated sections of roof edge plate 152, however, at ends 156, 157 the gap between ends 15 of drip edge 10 often causes flow of fluids such as runoff from the roof to seep under drip edge 10 and be absorbed by the wooden portions of the roof construction 150.

In this invention, referring to FIG. 1, a pitched roof construction 150 comprising roof decking portions 155, rafters (not shown) supporting the roof decking portions 155, roof edge plates 152 affixed to mitered ends (not shown) of the rafters adjacent the open outer edge 160 of the roof construction 150, a roof covering (not shown) overlying the roof decking portions 155, means for resisting flow of fluids 110 overlying at least a portion of the roof edge plates 152 and a portion of the roof decking 155 underneath the roof covering, the means for resisting flow 110 comprising elongated sections 111 of thin material having a T-shaped cross section and at least one fabricated corner assembly 20, 50 formed from at least one of the elongated sections 111. It is apparent to those skilled in the art that building of the roof construction 150 proceeds in the normal manner except that prior to applying roof drip edge 10, roof construction 150 has the novel hip corner assembly 50, 50A adapted to mate with a hip corner 159 of roof construction 150 and be affixed to end 157 of hip juncture 154 and may further have the novel valley corner assembly 20 adapted to mate with a valley corner 158 of roof construction 150 affixed to the end 156 of valley juncture 153 respectively. Thereafter, straight sections 111 of drip edge 10 are applied over the free ends 35, 45, 65 and 75 of the corner assemblies 20, 50 with ends 15 of straight sections 111 of drip edge 10 overlapping the ends of corner assemblies 20, 50 and/or 50A. It is common practice to overlap the ends 15 of straight sections 111 by approximately two inches although a greater or lesser amount may be utilized as well. The completed roof construction 150 of the instant invention provides for a substantially water tight outer roof edge 160 along roof edge plate 152 and especially at ends 156, 157 of junctures 153, 154.

Figure 2:
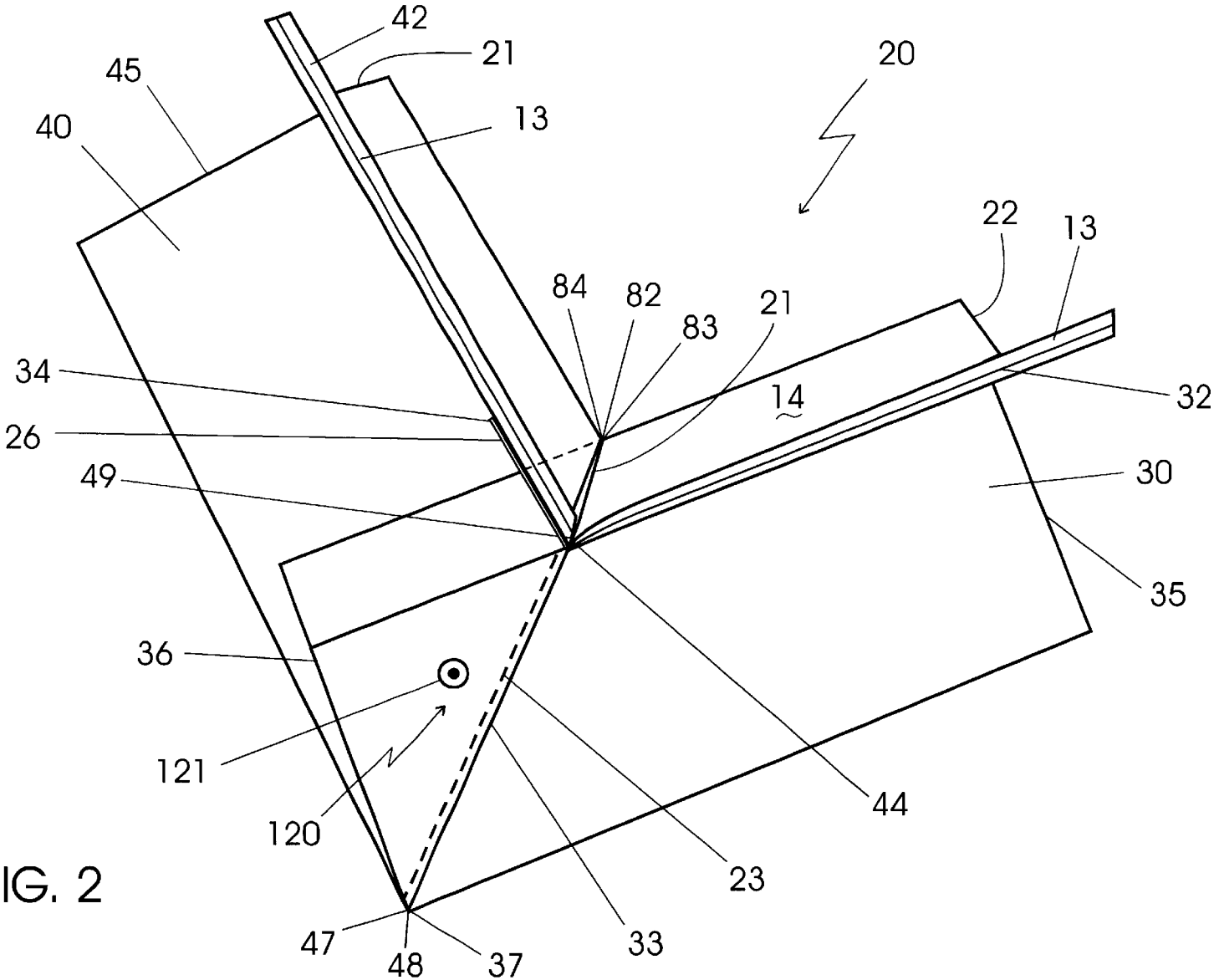
FIG. 2 is an inverted partially perspective view of the preferred embodiment of valley corner assembly n the straight cut portion underling the miter cut portion.
Figure 7:
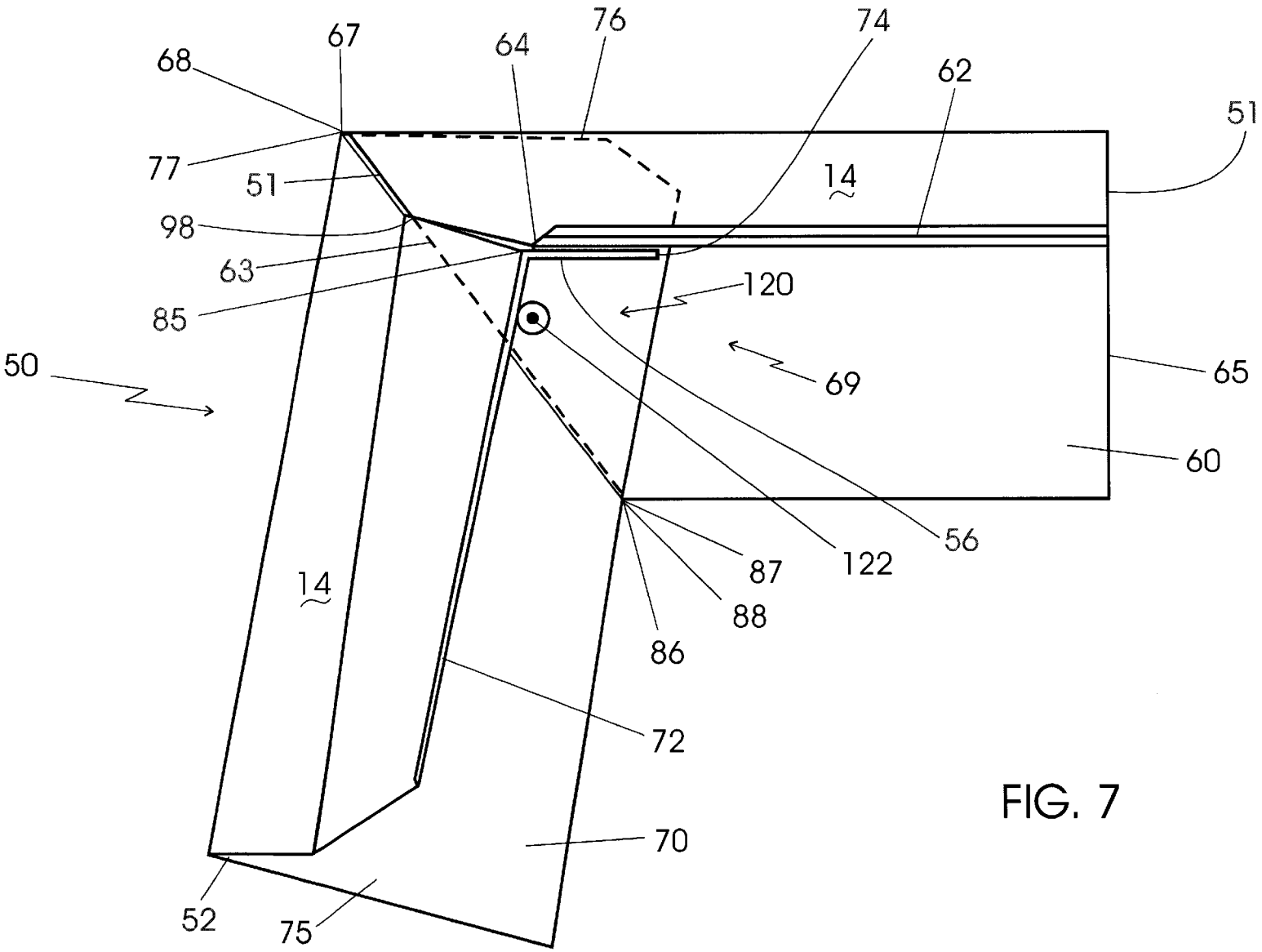
FIG. 7 is an inverted partially perspective view of the preferred embodiment of hip corner assembly showing the straight cut portion underling the miter cut portion.

Referring now to FIGS. 2 and 7, each fabricated corner assembly 20, 50 comprises at least one elongated miter cut portion 40, 60 miter cut from an elongated section 111 of thin material on at least one end 23, 53 thereof thereby forming at least one angled cut 43, 63 and at least one elongated bent tab portion 30, 70 straight cut from an elongated section 111 of thin material on at least one end 35, 59, 75, 99 thereof at least one original terminal end 35, 59, 75, 99 of each straight cut bent tab portion 30, 70 adapted to be bent to form a joint tab 36, 76 to underlie angled cut 43, 63 of miter cut portions 40, 60 respectively. Each fabricated corner assembly 20, 50 has means for retaining 120 joint tab 36, 76 of each straight cut bent tab portion 30, 70 underlying an angled joint end 46, 66 of miter cut portion 40, 60 to joint end 46,66 thereof It can be readily observed in FIGS. 2 and 7 that joint tab 36,76 of straight cut bent tab portion 30, 70 extend into a folded edge 21, 51 of miter cut portion 40, 60, folded edge 21, 51 of miter cut portion 40, 60 of fabricated corner assembly 20, 50 comprising a shingle extension 14 between the drip flange 42 and 62 and the roof flange 11 thereof folded edge 21, 51 mating with a folded edge 22, 52 of straight cut bent tab portion 30, 70 of fabricated corner assembly 20, 50, folded edge 22, 52 of straight cut bent tab portion 30, 70 comprising a shingle extension 14 between the drip flange 32 and 72 respectively and the roof flange 11 thereof.

Figure 8:
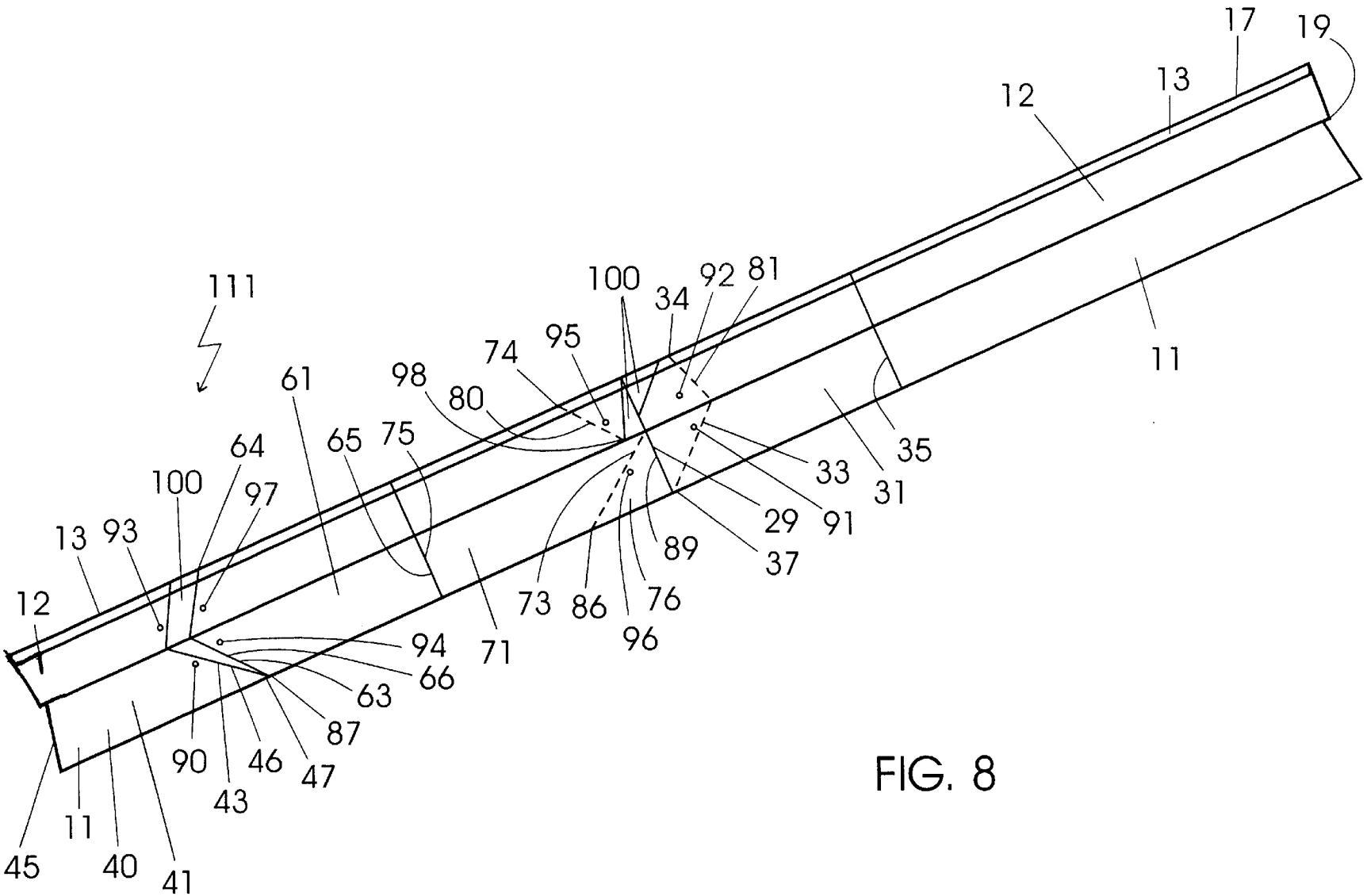
FIG. 8 is an inverted plan view of an elongated drip edge viewed at an angle of approximately 45° the roof engaging surface and prior to cutting the miter cut portions of FIGS. 3 and 4 and the straight cut portions of FIGS. 5 and 6 therefrom showing the arrangement thereof to minimize waste.

Referring now to FIGS. 2, 3, 6 and 8, the novel valley corner assembly 20 of this invention is first shown in FIG. 8 as being cut from a straight section 111 of thin material or drip edge 10 into two separate pieces 30, 40. Bent tab portion 30 is cut at free end 35 parallel to an end of an elongated piece of drip edge 10 and at original terminal end 59 spaced therefrom wile miter cut portion 40 is cut from an opposite end of an elongated piece of drip edge 10 at angled cut 43 spaced from free end 45, free end 45 comprising the opposite end thereof. Of course free end 45 may be cut simultaneously with free end 35, and in fact, since the portions 30, 40, 60 and 70 of multiple valley corner assemblies 20 and hip corner assemblies 50 may be cut from a single elongated piece of drip edge 10, it should be readily appreciated that free end 45 of miter cut portion 40 would be so established upon cutting of free end 35 of bent tab portion 30. The cutting of portions 30, 40, 60 and 70 will be described in full detail hereinafter.

Referring now specifically to FIG. 2 the novel valley corner assembly 20 is shown in inverted position with free ends 35 and 45 lying flat upon the plane of the paper and valley juncture point 48 elevated thereabove. Therefore, in order to best show the relationship of bent tab portion 30 affixed to miter cut portion 40, all remaining portions of valley corner assembly 20 are elevated above the plane of the paper upon which free ends 35, 45 lie. Bent tab portion 30 has two tabs 26, 36 formed from a drip flange 32 and a roof flange 11 respectively. Drip tab 26 is bent at approximately a ninety degree (90°) angle relative to drip flange 32 and is adapted to be fit around an up standing drip flange 42 of miter cut portion 40. Bent tab portion 30 has means for retaining 120 associated therewith to affix drip tab 26 to upstanding drip flange 42 thereto, for instance with a rivet (not shown) passed through holes 92, 93 (see FIG. 8) in drip tab 26 and drip flange 42. Thus, drip flange 32, 42 of valley corner assembly 20 for the roof construction 150 is adapted to be made continuous around end 156 of valley juncture 153. Similarly, joint tab 36 has been bent downwardly such that it lies under and contiguous with a portion of roof engaging surface 41 of miter cut portion 40. As can be readily observed in FIG. 2, fabricated valley corner assembly 20 comprises joint tab 36 of straight cut bent tab portion 30 extending into folded edge 21 of miter cut portion 40. It is fully appreciated here, that drip tab 26 is adapted to be contiguous with an outer surface 17 of drip flange 12 and thus underlies angled folded edge 13 and is not visible in FIG. 2 although joint tab 36 is fully visible in FIG. 2 as valley corner assembly 20 is shown in the aforementioned inverted position. The fabricated valley corner assembly 20 for a pitched roof construction 150 has means for retaining 120 joint tab 36 of each straight cut bent tab portion 30 underlying the joint end 46 of the miter cut portion 40 to joint end 46 of miter cut portion 40. Means for retaining 120 may be accomplished by a rivet 121 passing through holes 91 and 90 of joint tab 36 and roof flange 11 respectively thereby affixing joint tab 36 to miter cut portion 40. Means for retaining 120 may be accomplished in other ways as will be hereinafter described. Thus, roof flange 11 of valley corner assembly 20 for roof construction 150 is made continuous across the decking 155 around end 156 of valley juncture 153.

Figure 3:
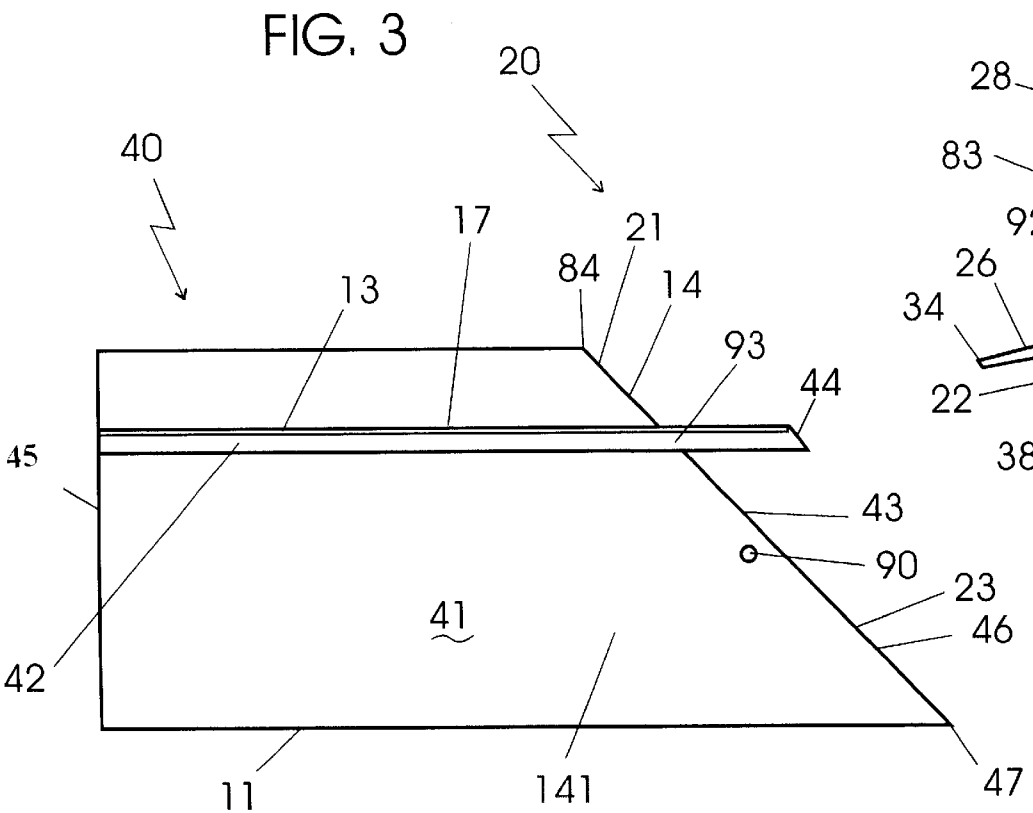
FIG. 3 is an inverted plan view of the miter cut portion of the valley corner of FIG. 2. inverted plan view of the miter cut portion of the hip corner of FIG. 7.

Miter cut portion 40 shown in FIG. 3, lies inverted upon the plane of the paper with exposed roof engaging surface 41 parallel to the plane of the paper and drip flange 42 perpendicular thereto. Similarly, bent tab portion 30 shown in FIG. 6 originally lies flat upon the plane of the paper as indicated by the solid outline extended by the dashed outline lines 39, however, since joint tab 36 is bent downwardly into the plane of the paper, bent tab portion 30 does not remain flat upon the plane of the paper but has its central portions elevated thereabove. In fact, once bent tab portion 30 is readied for use in assembling valley corner assembly 20, only free end 35, fold point 37 and terminal end point 18 contact the plane of the paper. Joint tab 36 is bent downwardly into the plane of the paper approximately thirty (30°) degrees.

Figure 6:
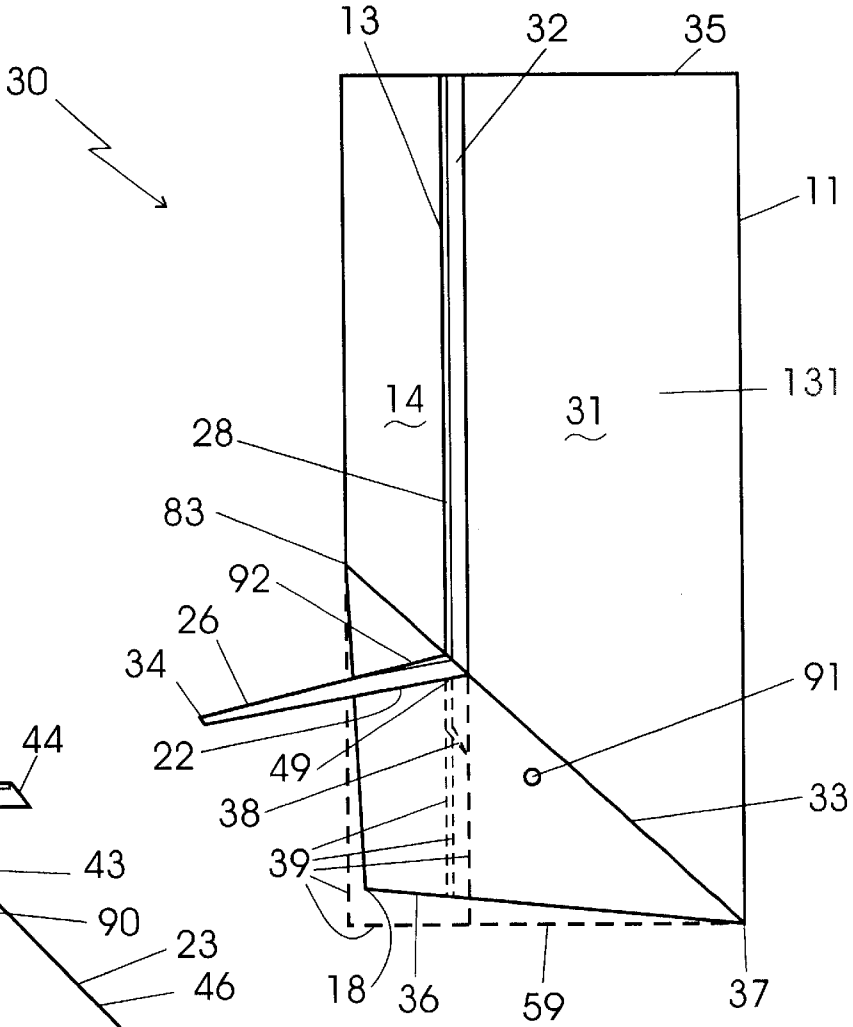
FIG. 6 is an inverted plan view of the straight cut portion of the valley corner of FIG. 2 showing both the initial cut configuration and the pre-assembly configuration.

Specifically referring to FIGS. 2, 3 and 6, valley corner assembly 20 is assembled by placing bent tab portion 30 and miter cut portion 40 in the proximate ninety degree (90°) angle relationship shown between FIGS. 3 and 6. Bent tab portion 30 is moved laterally toward miter cut portion 40 with joint tab 36 inserted into folded edge 21 in shingle extension 14 of miter cut portion 40, joint tab 36 extending over a portion of roof engaging surface 41 while drip tab 26 is placed adjacent upstanding drip flange 42 contiguous with outer surface 17. Bent tab portion 30 is then further moved laterally into miter cut portion 40 bringing juncture point 83 of bent tab portion 30 into contact with juncture point 84 of miter cut portion 40 forming shingle extension juncture 82 of valley corner assembly 20. Similarly, fold line 33 of bent tab portion 30 moves into registration with angled joint end 46 of miter cut portion 40 having sharp point 47 thereon joining with fold point 37 of bent tab portion 30 forming valley juncture point 48. Thereafter, bent tab portion 30 may be secured to miter cut portion 40 by providing means of retaining 120 such as by drilling a rivet hole 90, 91 through joint tab 36 and roof flange 11 and riveting these two portions together at this one point. However, there is nothing to prevent limited rotation of bent tab portion 30 around rivet 121 through holes 90, 91 and thereby away from miter cut portion 40 and therefore means of retaining 120 such as rivet holes 92, 93 are also provided through drip tab 26 and drip flange 42 with a rivet (not shown) passing through these two holes 92, 93 as well. Even though bent tab portion 30 and miter cut portion 40 are secured together with means for retaining 120, drip flanges 32, 42 may still flex relative to roof engaging surfaces 31, 41 respectively as shingle extension 14 is merely a portion of roof flange 11 folded back upon itself prior to forming of drip flange 12.

Still referring to FIGS. 3 and 6, those skilled in the art will appreciate that joint tab 36 of bent tab portion 30 may also be inserted into folded edge 21 at juncture point 84 by placing bent tab portion 30 above miter cut portion 40 and sliding joint tab 36 over roof engaging surface 41 until the portions 30, 40 come into registry along angled joint end 46 and fold line 33. Once bent tab portion 30 is in fill registry with miter cut portion 40, flange end point 44 becomes contiguous with an upper edge 28 of drip flange 32 at interior corner 49 and flange end 34 of drip tab 26 lies substantially along the outer surface 17 of drip flange 42 adjacent angled folded edge 13 of drip flange 12.

Figure 5:
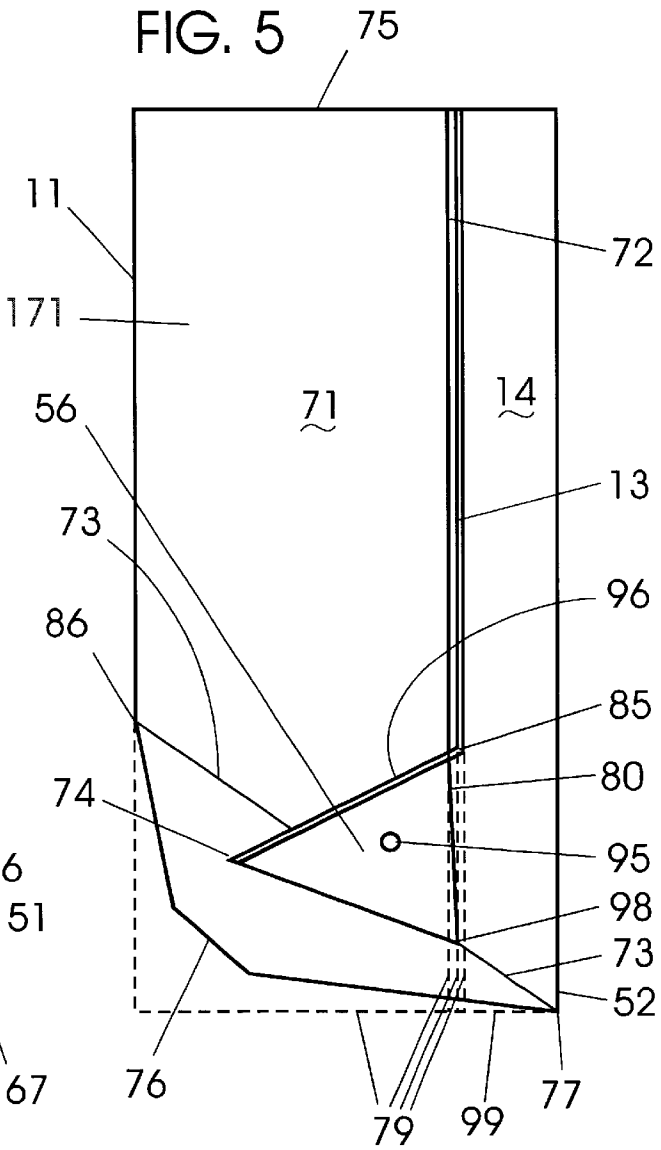
FIG. 5 is an inverted plan view of the straight cut portion of the hip corner of FIG. 7 showing both initial cut configuration and the pre-assembly configuration.
Figure 4:
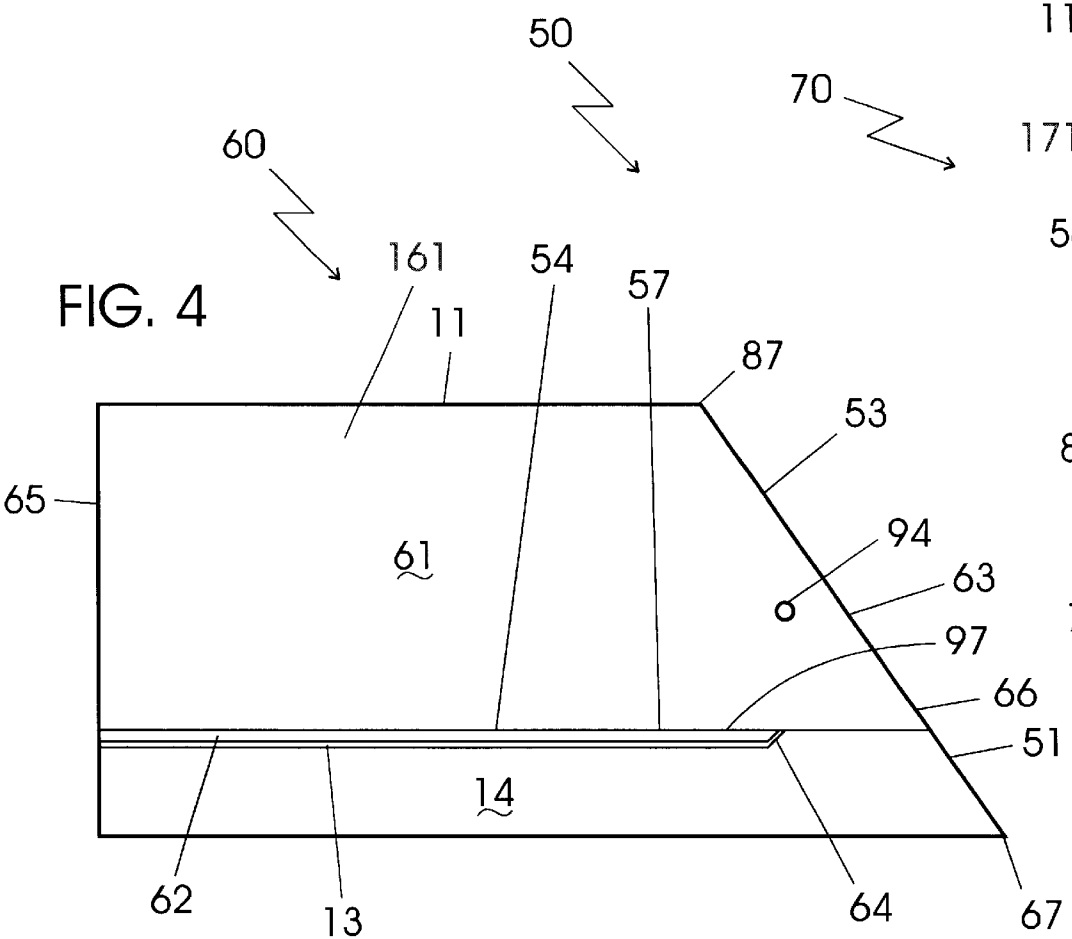

Referring now to FIGS. 4, 5, 7 and 8, the novel hip corner assembly 50 of this invention is first shown in FIG. 8 as being cut from a straight section 111 of drip edge 10 into two separate pieces 60, 70. Miter cut portion 60 and bent tab portion 70 are separated along straight cut free ends 65, 75 from a piece of drip edge 10 by cutting perpendicularly straight through drip flange 12, roof flange 11 and shingle extension 14 although either piece could be cut from either end of an elongated piece of drip edge 10. An angled cut 63 spaced from free end 65, is made through a drip flange 12 passing through roof flange 11 resulting in miter cut portion 60. Preferably, angled cut 63 is cut adjacent angled cut 43 of miter cut portion 40 thereby reducing the waste of cutting each piece separately from a piece of drip edge 10. In FIG. 4, miter cut portion 60 is shown lying upside down upon the plane of the paper with roof flange 11 lying on the plane and drip flange 62 extending perpendicularly upwardly therefrom. In FIG. 5, bent tab portion 70 also lies in an upside down position with roof flange 11 lying on the plane of the paper and drip flange 72 extending perpendicularly upwardly therefrom. Joint tab 76 is bent upwardly from the plane of the paper into the position shown by the solid lines in FIG. 5 while the dashed lines 79 show the position of joint tab 76 prior to bending upwardly and may have the outer point truncated as shown. Thus, after forming joint tab 76, the remainder of roof flange 11 of bent tab portion 70 remains flat upon the plane of the paper.

Referring now specifically to FIG. 7, the novel hip corner assembly 50 is shown in inverted position with roof flange 11 of miter cut portion 60 lying flat upon a flat plane and bent tab portion 70 elevated thereabove beginning at fold line 73. Therefore, in order to best show the relationship of bent tab portion 70 affixed to miter cut portion 60, all remaining portions of bent tab portion 70 are elevated above the plane of the paper upon which miter cut portion 60 lies. Bent tab portion 70 has two tabs 56, 76 formed from a drip flange 72 and a roof flange 11 respectively. Drip tab 56 is bent at approximately a ninety degree (90°) angle relative to drip flange 72 and is adapted to be fit around upstanding drip flange 62 of miter cut portion 60 and affixed thereto by means for retaining 120 such as with a rivet (not shown) passed through holes 96, 97 (see FIG. 8) in drip tab 56 and drip flange 62 respectively. Thus, drip flange 12 for hip corner assembly 50 for roof construction 150 is made continuous around end 157 of hip juncture 154. Similarly, joint tab 76 has been bent upwardly such that it lies under and contiguous with a portion of roof engaging surface 61 of miter cut portion 60. Joint tab 76 is also fixed to miter cut portion 60 by means for retaining 120 such as with a rivet 122 passing through holes 94 and 96 of joint tab 76 and miter cut portion 60 respectively. Thus, roof flange 11 for the roof construction 150 is made continuous across the decking 155 around end 157 of hip juncture 154.

Specifically referring to FIGS. 4, 6 and 7, the novel hip corner assembly 50 of this invention is assembled by inserting joint tab 76 of bent tab portion 70 into a folded edge 51 in shingle extension 14 of miter cut portion 60 and sliding joint tab 76 along roof engaging surface 61 until joint tab 76 becomes fully engaged therewith and drip tab 56 is in place adjacent to and contiguous with upstanding drip flange 42. The foregoing is accomplished while holding miter cut portion 60 directly below and in the inverted fashion shown in FIG. 4 at a ninety degree (90°) angle to bent tab portion 70 in the same relationship between the parts as shown in FIG. 4. When joint tab 76 is fully engaged in folded edge 51, roof flange juncture point 86 of bent tab portion 70 should be in contact with roof flange juncture point 87 of miter cut portion 60 forming shingle extension juncture 88 of hip corner assembly 50. Similarly, fold line 73 of bent tab portion 70 moves into registration with angled joint end 66 of miter cut portion 60 having sharp point 67 thereon joining with fold point 77 of bent tab portion 70 forming hip juncture point 68. Thereafter, bent tab portion 70 may be secured to miter cut portion 60 by means for retaining 120 such as by drilling a rivet hole 96 through joint tab 76 and hole 94 through roof flange 61 of miter cut portion 60 and affixing these two portions together at this one point. However, there is nothing to prevent some limited rotation of bent tab portion 70 around the rivet 122 just placed through holes 94, 96 and thereby away from miter cut portion 60 and therefore means for retaining 120 such as rivet holes 95, 97 are also provided through drip tab 56 and drip flange 62 respectively with a rivet (not shown) passing through these two holes 95, 97 as well. Even though bent tab portion 70 and miter cut portion 60 are secured together with means for retaining 120 at these two locations, drip flanges 62, 72 may still flex relative to roof engaging surfaces 61, 71 respectively as shingle extension 14 is merely a portion of roof flange 11 folded back upon itself prior to forming of drip flange 12.

Although the holes 90–97 have been described as drilled through the respective portions upon assembly of valley corner assembly 20 and hip corner assembly 50, holes 90–97 could be established through drip edge 10 at the time each piece 30, 40, 60, 70 is being cut therefrom as shown in FIG. 8 or alternately after cutting the various pieces therefrom.

Referring to FIGS. 4 and 5, those skilled in the art can appreciate that joint tab 76 of bent tab portion 70 may be inserted into folded edge 51 of miter cut portion 60 by moving these portions 60, 70 represented in the figures into proximity with each other such as by moving FIG. 5 to the left until it overlies FIG. 4 and thus joint tab 76 overlies roof surface 61 of miter cut portion 60 and thereafter moving bent tab portion 70 downwardly into folded edge 51 and into registry with miter cut portion 60 along angled joint end 66 and fold line 73. Once bent tab portion 70 is in full registry with miter cut portion 60, flange end point 64 becomes contiguous with an upper edge of joint bend 85 of drip flange 72 and sharp flange end 74 of drip tab 56 lies substantially along the inside bottom edge 54 of drip flange 62 adjacent folded edge 51.

Referring now to FIGS. 3 and 8, miter cut portion 40 is laid out at a square end, thus establishing free end 45, of an elongated piece of drip edge 10, drip edge 10 being in an inverted position with its roof flange 11 lying flat upon a plane and with its drip flange 12 extending perpendicular to the plane. Drip flange 12 has a folded edge 13 thereby doubling the thickness of drip flange 12 along folded edge 13 providing some rigidity to drip flange 12. In the preferred embodiment described herein, folded edge 13 is further bent slightly away from the plane of drip flange 12 and thus when installed upon a roof edge plate 152, folded edge 13 is bent away therefrom. Folded edge 13 has been omitted from FIG. 8 for clarity. Similarly, a doubled over folded edge may be also provided on roof flange 11, however, it has been omitted from all drawings to reduce the complexity thereof If one end of an elongated piece of drip edge 10 is not square, a square cut should be made perpendicular to both drip flange 12 and roof flange 11 thereby establishing free end 45. Miter cut portion 40 is then severed from elongated drip edge 10 by making a double miter cut through drip flange 12 and roof flange 11 at one end 23 spaced a distance from free end 45. Typically, sharp point 47 of miter cut portion 40 should be spaced approximately eight inches from free end 45 though miter cut portions 40 may be longer or shorter as desired. The double miter angled cut 43 is made at substantially forty five degrees (45°) through roof flange 11 with respect to drip flange 12 and at an angle of substantially sixty (60°) degrees through drip flange 12 with respect to roof flange 11. The sixty (60°) degree cut through drip flange 12 is also made back toward free end 45 such that flange end point 44 overhangs angled joint end 46. Miter cut portion 40 is thus bound by sharp end point 47, flange end point 44, juncture point 84 and free end 45. Although free end 45 is shown and described as being square to the flanges 11, 12 of drip edge 10, some roof constructions 150 may dictate that an angled cut be made on both ends 23, 45 of miter cut portion 40 such that a valley corner assembly 20 and hip corner assembly 50 may be made arranged in close proximity.

Referring now to FIGS. 4 and 8, miter cut portion 60 is laid out opposing miter cut portion 40 of FIG. 3 on an elongated piece of drip edge 10, drip edge 10 being in an inverted position as described above. Miter cut portion 60 may be severed from elongated drip edge 10 by making a double miter cut at one end 53 through drip flange 12 and roof flange 11 beginning at the coincident sharp point 47 of miter cut portion 40 and roof flange juncture point 87 of miter cut portion 60. The double miter angled cut 63 is made at substantially fifty five (55°) through roof flange 11 with respect to drip flange 12 and at an angle of substantially sixty five (65°) degrees through drip flange 12 with respect to roof flange 11. The sixty five (65°) degree cut through drip flange 12 is also made away from free end 65 and back toward the now open end of the elongated piece of drip edge 10 established with the cutting of end 23 of miter cut portion 40 such that flange end point 64 does not overhang angled joint end 66 but rather resides over roof engaging surface 61 spaced away from angled joint end 66. Spaced from angled cut 63 is a free end 65 which is generally cut square with elongated piece of drip edge 10, that is, perpendicular to drip flange 12 and roof flange 11. Typically, sharp point 67 of miter cut portion 60 should be spaced approximately eight inches from free end 65 though miter cut portion 60 may be longer or shorter as desired. Miter cut portion 60 is thus bound by sharp end point 67, flange end point 64, roof flange juncture point 87 and free end 65. As the angled cuts 43, 63 oppose each other, a eight inch long miter cut portion 40 and a eight inch long miter cut portion 60 may be cut from a piece of drip edge 10 approximately ten inches in length.

In FIG. 8, it is apparent that little waste is created by thus cutting miter cut portion 60 and miter cut portion 40 from the same elongated piece of drip edge 10 by arranging miter cut portion 60 to oppose miter cut portion 40. The waste portion is shown in FIG. 8 by reference numeral 100 and comprises a wedge shaped portion of shingle extension 14, drip flange 12 and roof flange 11 between miter cut portion 40 and miter cut portion 60. It is also apparent that the only waste created in cutting bent tab portion 70 and bent tab portion 30 from an elongated piece of drip edge 10 is a small wedge shaped waste portion 100 of drip flange 12 of bent tab portion 70 between bent tab portion 30 and bent tab portion 70 as will hereinafter be described.

Referring now to FIGS. 5 and 8, bent tab portion 70 is laid out adjacent miter cut portion 60 of FIG. 4 on an elongated piece of drip edge 10, drip edge 10 being in an inverted position as described above. Free end 75 of bent tab portion 70 is formed when free end 65 is cut to form miter cut portion 60 as the square cut end of free end 65 is identical to the square cut free end 75. Spaced from free end 75 is another square cut 89 forming both origin al ends 59 and 99 of bent tab portion 30 and bent tab portion 70 respectively. Free end 75 is typically spaced from terminal end 99 approximately eight inches although a greater or lesser distance may be utilized and still fall within the scope of this invention. In FIG. 5, original terminal end 99 is shown as a dashed line spaced from free end 75 joining with other dashed lines 79 to show the original flat portion of roof flange 11 of bent tab portion 70. The dashed lines in FIG. 8 are used to show fold lines 33, 73, 80, 81 for creating the tab portions 26, 36, 56 and 76 of bent tab portions 30, 70 respectively. A small wedge shaped waste portion 100 is created by a sixty (60°) degree cut in drip flange 12, this waste portion 100 shown centrally located near the top of FIG. 8. This waste portion 100 extends downwardly from flange end sharp point 74 to a cut line terminus 98 which was created by cutting through drip flange 12 along the base thereof from terminal end 99 to terminus 98. The cut along the base of drip flange 12 establishes drip tab 56 and merely separates the wedge shaped waste portion 100 from drip edge 10 at roof engaging surface 71.

Referring now to FIGS. 6 and 8, bent tab portion 30 is laid out adjacent bent tab portion 70 of FIG. 5 on an elongated piece of drip edge 10, drip edge 10 being in an inverted position as described above. Terminal end 59 of bent tab portion 30 is formed when terminal end 59 is cut to form bent tab portion 70 as hereinbefore described. Free end 35 is another square cut spaced from original terminal end 59 of bent tab portion 30 and is typically spaced from terminal end 59 approximately eight inches although a greater or lesser distance may be utilized and still fall within the scope of this invention. In FIG. 6, original terminal end 59 is shown as a dashed line spaced from free end 35 joining with other dashed lines 39 to show the original position of roof flange 11 and drip flange 12 of bent tab portion 30. As noted above, the dashed lines in FIG. 8 are used to show fold lines 33, 73, 80, 81 for creating the tab portions 26, 36, 56 and 76 of bent tab portions 30, 70 respectively. Drip tab 26 is established by cutting through drip flange 12 along the base thereof from terminal end 59 to fold line 73 thus separating drip tab 26 from roof flange 11 such that drip tab 26 may be bent at a ninety degree (90°) angle along fold line 81. Drip tab 26 further has a waste portion 100 removed from drip flange 12 as shown in FIG. 8 adjacent the waste portion 100 removed from drip flange 12 during the cutting of bent tab portion 70 as hereinbefore described. The end of truncated portion 38 of folded edge 13 is shown in FIG. 6 as a dashed point intermediate dashed lines 39 depicting the original position of drip flange 12.

In the preferred embodiment, the fabricated corner assembly 20, 50 of this invention has means for retaining 120 comprising a rivet passed through mating holes provided in roof flange 41, 61 of miter cut portion 40, 60 and roof flange 31, 71 of straight cut portion 30, 70 and alternately or additionally with a rivet passed through mating holes provided in drip flange 42, 62 of miter cut portion and drip tab of straight cut portion 30, 70 as hereinbefore described.

Means for retaining 120 may further comprise an adhesive disposed in the folded edge 21, 51 of the miter cut portion 40, 60 and on roof engaging surface 41, 61 thereof and therefore between joint tab 36, 76 of straight cut portion 30, 70 and roof engaging surface 41, 61 and alternately or additionally between drip flange 42, 62 of miter cut portion 40, 60 and drip tab 26, 56 of straight cut portion 30, 70 respectively. For instance, referring now to FIGS. 3 and 6, during the assembly of valley corner assembly 20, an adhesive may be provided in folded edge 21 and along a portion of roof engaging surface 41 adjacent angled joint end 46 such that when joint tab 36 is inserted into folded edge 21 and bent tab portion 30 is moved laterally over miter cut portion 40 bringing juncture point 83 of bent tab portion 30 into contact with juncture point 84 of miter cut portion 40, bent tab portion 30 is retained against miter cut portion 40. In addition or alternately, as fold line 33 of bent tab portion 30 moves into registration with angled joint end 46 of miter cut portion 40 having sharp point 47 thereon an adhesive may be provided along outer surface 17 of upstanding drip flange 42 joining drip tab 26 of bent tab portion 30 to drip flange 42.

In like manner, referring now to FIGS. 4 and 5, during the assembly of hip corner assembly 50, an adhesive may be provided in folded edge 51 and along a portion of roof engaging surface 61 adjacent angled joint end 66 such that when joint tab 76 is inserted into folded edge 51 and bent tab portion 70 is moved laterally over miter cut portion 60 bringing roof flange juncture point 86 of bent tab portion 30 into contact with roof flange juncture point 87 of miter cut portion 60, bent tab portion 70 is retained against miter cut portion 60. In addition or alternately, as fold line 73 of bent tab portion 70 moves into registration with angled joint end 66 of miter cut portion 60 having sharp point 67 thereon an adhesive may be provided along inside surface 57 of upstanding drip flange 62 joining drip tab 56 of bent tab portion 70 to drip flange 62.

Means for retaining 120 may optionally comprise welding the roof flange of miter cut portion 40, 60 to the roof flange of straight cut portion 30, 70 and may also optionally comprise welding the drip flange of miter cut portion 40, 60 to the drip flange of straight cut portion 30, 70. Assembly of the novel valley corner assembly 20 of this invention proceeds in the same manner as described above for riveting the two portions 30, 40 together, however, in place of drilling the aforementioned holes, miter cut portion 40 and bent tab portion 30 are held in their respective relationships after assembly and a weld is placed along angled joint end 46 from shingle extension juncture point 82 to valley juncture point 48 and optionally along original terminal end 59 of joint tab 36 onto roof engaging surface 41. Other welds may be placed as well as one skilled in the art of welding may choose. Welding of hip corner assembly 50 is similar but requires welding of drip flanges 62, 72 on the exposed surface from flange end point 64 along joint bend 85 to hip juncture point 68. Hip corner assembly 50 may be welded along joint tab 76 from hip juncture point 68 to shingle extension juncture 88.

Although means for retaining 120 has heretofore been described as being completed prior to placement of the novel corner assembly 20, 50 of this invention on a roof construction 150, it is to be understood that means for retaining 120 may be accomplished at assembly of the miter cut portions 40, 60 and bent tab portions 30, 50 directly upon roof edge plate 152 and roof decking 155. For instance, while holding either miter cut portion 40 and bent tab portion 30 or miter cut portion 60 and bent tab portion 70 together as described above, means for retaining 120 may comprise nails driven through roof flange 41, 61 of miter cut portion 40, 60, roof flange 31, 71 of straight cut bent tab portion 30, 70 and directly into roof decking 155 at least near juncture points 48, 68 and ends 35, 45, 65 and 75 of the respective parts. Optionally or additionally, while holding the assembled miter cut portion 40, 60 and bent tab portion 30, 70 together respectively as described above, means for retaining 120 may comprise nails driven through drip flange 42, 62 of miter cut portion 40, 60, drip flange 32, 72 of straight cut bent tab portion 30, 70 into roof edge plate 152.

Novel valley corner assembly 20 and novel hip corner assembly 50 of this invention are adapted to be used on roof constructions 150 of various pitch as the drip flanges 32, 42, 62 and 72 and roof engaging flanges 31, 41, 61 and 71 can be flexed relative to each other when installing the novel corners 20, 50 thereon. For example, a roof construction 150 having a 4 pitch has an angle between roof edge plate 152 and roof decking 155 of approximately 18.4 degrees while a roof construction 150 having a 12 pitch has an angle of approximately 45 degrees between these respective surfaces. As a novel valley corner assembly 20 of this invention is placed in position upon end 156 of valley juncture 153 having interior corner 49 thrust thereinto in contiguous contact therewith, a fastener may be driven through roof flange 11 near valley juncture point 48 thereby fastening the central portion of valley corner assembly 20 to roof construction 150. Thereafter, free ends 35, 45 may be moved along the surface of decking 155 until drip flanges 32, 42 come into contact with roof edge plate 152. A fastener is then driven into decking 155 through roof flange 11 near free ends 35, 45. Since the ends 35,45 of valley corner assembly 20 are flexible and each valley corner 20 is thrust into engagement with end 156 of valley juncture 153 and affixed thereto, the installation of valley corner assembly 20 is the same on each roof construction 150 without regard to the pitch of the roof.

In a similar manner, a novel hip corner assembly 50 of this invention is placed in position upon end 157 of hip juncture 154 having interior corner 69 thrust thereinto in contiguous contact therewith, a fastener may be driven through roof flange 11 near hip juncture point 68 thereby fastening the central portion of hip corner assembly 50 to roof construction 150. Thereafter, free ends 65, 75 may be moved along the surface of decking 155 until drip flanges 62, 72 come into contact with roof edge plate 152. A fastener may then be driven into decking 155 through roof flange 11 near free ends 65, 75. Since the free ends 65, 75 of hip corner assembly 50 are flexible and each hip corner assembly 50 is thrust into engagement with end 157 of hip juncture 154 and affixed thereto, the installation of valley corner assembly 20 is the same on each roof construction 150 without regard to the pitch of the roof.

A method of providing a pitched roof construction 150 for a building construction comprises affixing rafters (not shown) to the upper edge of upstanding walls of the building construction, joining the rafters at at least one hip juncture 154 of roof construction 150, affixing a roof edge plate 152 to free ends of rafters overhanging the upstanding walls of the building construction, applying roof decking 155 over the rafters, roof decking 155 joining at at least one hip juncture 154, applying means for resisting flow 110 of fluids overlying at least a portion of roof edge plates 152 and a portion of roof decking 155 underneath a roof covering, means for resisting flow 110 comprising elongated straight sections 111 of thin material having a T-shaped cross section and wherein means for resisting flow 110 further comprises at least one fabricated corner assembly 20, 50 formed from at least one of the elongated straight sections 111. The method further comprises corner assembly 20, 50 adapted to have the free ends 35, 45, 65, 75 thereof overlapped with straight sections 111 of thin material wherein at least one fabricated corner assembly 20 is adapted to mate with a hip corner 159 of a building construction and is applied and affixed thereto and at least one fabricated corner assembly 50 is adapted to mate with a valley corner 158 of a building construction and is applied and affixed thereto.

In FIG. 1, there is also provided a drip edge construction 130 for a pitched roof construction 150, pitched roof construction 150 comprising roof decking 155, rafters supporting roof decking 155, roof edge plates 152 affixed to mitered ends of the rafters and adjacent the outer edge 160 of roof decking 155, drip edge 10 overlying at least a portion of roof edge plates 152 and a portion of roof decking 155 and being affixed thereto, a roof covering overlying roof decking 155 and drip edge construction 130 and wherein drip edge construction 130 has straight sections 111 and fabricated corner assemblies 20, 50, each fabricated corner assembly 20, 50 comprising at least one elongated portion of drip edge material 10 miter cut on at least one end 23, 53 thereof forming miter cut portions 40, 60 having angled joint ends 46, 66 and at least one elongated portion of drip edge material 10 straight cut on at least one end 59, 99 thereof at least one end 59, 99 of each straight cut bent tab portion 30, 70 adapted to be bent forming bent tab portions 36, 56 to underlie at least one end of miter cut portion comprising angled joint end 46, 66 and be fixedly retained thereto.

Additionally, in FIGS. 1 through 8, in particular there is provided a pitched hip roof construction 150 of a building construction having at least four wall sections, the roof construction 150 comprising roof decking portions 155 joined at at least the exterior hip junctures 154 thereof the outer edge 160 of roof construction 150 overhanging the walls of the building construction terminating in a roof edge plate 152 affixed to the ends of roof rafters adapted to support the decking portions 155 and the subsequent exterior roofing materials, the roof construction 150 further having a roof drip edge 10 applied over the terminal end of decking portions 155 and roof edge plate 152, and wherein the end 157 of each hip juncture 154 has means for covering 140 affixed thereto prior to applying exterior roofing materials. In the pitched hip roof construction 150 above, means for covering 140 comprises a fabricated hip corner drip edge assembly 50 and a fabricated valley corner drip edge assembly 20 cooperating with drip edge 10 to reduce the intrusion of fluid flowing over outer edge 160 into roof construction 150.

Referring now to FIG. 8, in a method of making a fabricated hip corner assembly 50 and a fabricated valley corner assembly 20, an elongated straight section 111 of thin material is formed by folding an elongated flat strip of thin material at a folded edge 19 upon itself and thereafter forming an upright drip flange 12 perpendicular to a roof engaging flange 11, upright drip flange 12 being formed at a distance spaced from folded edge 19. An angled folded edge 13 may be formed upon the terminal edge of drip flange 12 by folding a short section of upright drip flange 12 upon it self mating the adjoining surfaces together. A similar folded edge may be formed at the terminal end of the roof flange 11, however this feature has been omitted from the drawings for clarity. Thus a drip edge 10 is formed from an elongated flat strip of thin material.

In the preferred method of forming miter cut portion 40, 60 and straight cut portion 30, 70, a thin strip of material of sufficient length is placed upon the working surface of a progressive die with roof engaging surface 31, 41, 61, 71 exposed wherein angled folded edge 13 overlies an angled edge of the working surface of a first die plate. Angled edge 13 is folded away from roof engaging surface 31, 41, 61, 71 when a second die plate clamps drip flange 32, 42, 62, 72 against the working surface of a first die plate. The second die plate additionally includes cutting edges to remove waste portion 100, sever miter cut portion 40 at angled cut 43, miter cut portion 60 at angled cut 63 and at free end 65 forming also free end 75 of straight cut portion 70, straight cut portion 70 at original free end 99 thereby also forming original free end 59 of straight cut portion 30 and finally at free end 35 thereof. In this preferred embodiment, holes 90–97 are pierced simultaneously with the cutting operations. The third stage of the die assembly comprises a series of upright plates disposed at a right angles to the working surface longitudinally thereof which are adapted to proceed downwardly into a series of slots disposed in the first die plate thereby forming folded edge 21, 22, 51, 52 by forcing a portion of the material into these slots while forming roof engaging flange 31, 41, 61, 71 alongside the series of upright plates. As waste 100 has been removed in the cutting process, miter cut portions 40, 60 may be removed from the die ready to assemble to straight cut portions 30, 70. However, straight cut portions 30, 70 further have joint tab 36, 76 and drip tab 26, 56 formed in a separate operation. For instance, bent tab portion 36 is formed in a narrow bight, such as the jaws of a vise by placing original terminal end 59 thereinto to fold line 33 and bending same downwardly approximately 30°. Drip tab 26 is then formed by inserting flange end 34 into the narrow bight to fold line 81 and bending same away from drip flange 32 approximately 90° extending beyond shingle extension 14. In like manner, joint tab 76 is formed by placing original terminal end 99 into the bight of the vise and bending same upwardly along fold line 73 approximately 30° and drip tab 56 is inserted into the bight of the vise to fold line 80 and bent 90° away from drip flange 72 over roof engaging flange 71. Although the aforementioned die assembly is described as forming all portions 30, 40, 60, 70 simultaneously, individual die assemblies may be constructed to form each portion separately from an elongated strip of flat material in a manner similar to the forming of all portions 30, 40, 60, 70 as herein described.

Drip edge 10 may also be formed in an automatic folding machine wherein an elongated strip of thin material is fed into the nip of feeding rollers, a second pair of rollers adapted to turn a portion of the thin strip back upon itself forming folded edge 19 and thereafter a third set of rollers adapted to form drip flange 12 from a major portion of the remainder previously turned upon itself by standing drip flange 12 perpendicular to axis of the elongated strip. Yet a fourth set of rollers may be utilized to form angled folded edge 13 by turning a minor portion of drip flange 12 upon itself mating the adjoining surfaces and bending angled folded edge 13 at an angle away from the plane of drip flange 12. In the preferred embodiment, the thin strip of material is 12 gage aluminum sheeting approximately 5½" in width wherein roof flange 11 is approximately 2¾" wide, shingle extension 14 is approximately ¾" wide and drip flange 12 is approximately 2' wide. Angled folded edge 13 is less than ¼" in width and is angled from the plane of drip flange 12 at an angle of 45°. Although in this preferred embodiment aluminum sheeting is utilized, coated steel sheeting or thermoplastic sheeting of similar strength may be utilized. Thermoplastic sheeting would best be formed in an extrusion die of an extruder with the T-shaped cross section comprising the die opening.

After forming of drip edge 10 in a roller folder, the double miter cuts 43, 63, straight cuts 35, 45, 65, 75 and fold lines 33, 73, 80, 81 may be laid out upon the inside surface of drip flange 12 and roof flange 11 by any known means such as a carpenter's pencil or machinist's scribe utilizing the aforementioned layout description referring to FIG. 8. Thereafter, the cuts 35, 43, 45, 63, 65, 75 may be made by known means such as a common hacksaw or metal shears and bent tab portions 36 may be formed in a narrow bight, such as the jaws of a vise, by placing original terminal end 59 thereinto to fold line 33 and bending same downwardly approximately 30°. Drip tab 26 is then formed by inserting flange end 34 into the narrow bight to fold line 81 and bending same away from drip flange 32 approximately 90°. In like manner, joint tab 76 is formed by placing original terminal end 99 into the bight of the vise and bending same upwardly along fold line 73 approximately 30° and drip tab 56 is formed by inserting into the bight of the vise to fold line 80 and bending 90° away from drip flange 72.

Specifically referring to FIGS. 2, 3 and 6, valley corner assembly 20 is assembled by placing bent tab portion 30 and miter cut portion 40 in the proximate ninety degree (90°) angle relationship shown between FIGS. 3 and 6. Bent tab portion 30 is moved laterally toward miter cut portion 40 inserting joint tab 36 into folded edge 21 in shingle extension 14 of miter cut portion 40, joint tab 36 extending over a portion of roof engaging surface 41 while drip tab 26 is placed adjacent upstanding drip flange 42 contiguous with outer surface 17. Bent tab portion 30 is then further moved laterally into miter cut portion 40 bringing juncture point 83 of bent tab portion 30 into contact with juncture point 84 of miter cut portion 40 forming shingle extension juncture 82 of valley corner assembly 20. Similarly, fold line 33 of bent tab portion 30 is moved into registration with angled joint end 46 of miter cut portion 40 having sharp point 47 thereon joining with fold point 37 of bent tab portion 30 forming valley juncture point 48. Thereafter, bent tab portion 30 may be secured to miter cut portion 40 by means of retaining 120 as hereinbefore described. However, where means for retaining 120 comprises rivets through pre-drilled holes, there is nothing to prevent limited rotation of bent tab portion 30 around rivet 121 through holes 90, 91 and thereby away from miter cut portion 40, therefore means of retaining 120 such as rivet holes 92, 93 are also provided through drip tab 26 and drip flange 42 with a rivet (not shown) passing through these two holes 92, 93 as well.

Where other means of retaining 120 are utilized, separate securing of the drip flange 12 and the roof flange 11 is largely accomplished in the securing of either flange to the corresponding flange. In all means of retaining 120, even though bent tab portion 30 and miter cut portion 40 are secured together with means for retaining 120, drip flanges 32,42 may still flex relative to roof engaging surfaces 31,41 respectively as shingle extension 14 is merely a portion of roof flange 11 folded back upon itself prior to forming of drip flange 12. Thus the various parts are preferably pre-manufactured and sold as multiple pre-packaged valley corner assemblies 20 or hip corner assemblies 50 nested together in shrink pack or cardboard cartons thus making selection easy for a construction worker.

In an alternate method utilizing a roller folder, prior to the folding of the elongated strip of thin material, scoring lines may be provided by perforating the thin material at angled cut 43, angled cut 63, free ends 35, 45, 65, 75, cut line 29, truncated portion 38 from sharp point 74 to terminus 98 and from original terminal end 59 through drip flange 12 to fold line 73 such that after folding the elongated strip of thin material into a drip edge 10, miter cut portions 40, 60 and straight cut bent tab portions 30, 70 may be broken from the elongated strip 111. Thereafter, bent tab portions 36, 56 may be formed in a narrow bight, such as the jaws of a vise, by placing original terminal end 59 thereinto to fold line 33 and bending same downwardly approximately 30°. Drip tab 26 is then formed by inserting drip tab 26 into the narrow bight to fold line 81 and bending same away from drip flange 12 approximately 90°. In like manner, bent tab portion 70 is formed by placing original terminal end 99 into the bight of the vise and bending same upwardly along fold line 73 approximately 30° and drip tab 56 is inserted into the bight of the vise to fold line 80 and bent 90° away from drip flange 12. Fold lines 33, 73, 80 and 81 are marked on the flat strip of thin material prior to folding drip edge 10 into the T-shaped section and preferably are marked at the same time as the cut lines 29, 35, 43, 45, 63, 65, 75, 89 are scored. It is readily apparent therefore, that by providing a pre-scored, folded T-shaped drip edge 10, the portions 30, 40, 60, 70 of novel corner assemblies 20, 50 of this invention may be broken therefrom, assembled at the job site and affixed to roof construction 150 in the manners recited above.

Figure 9:
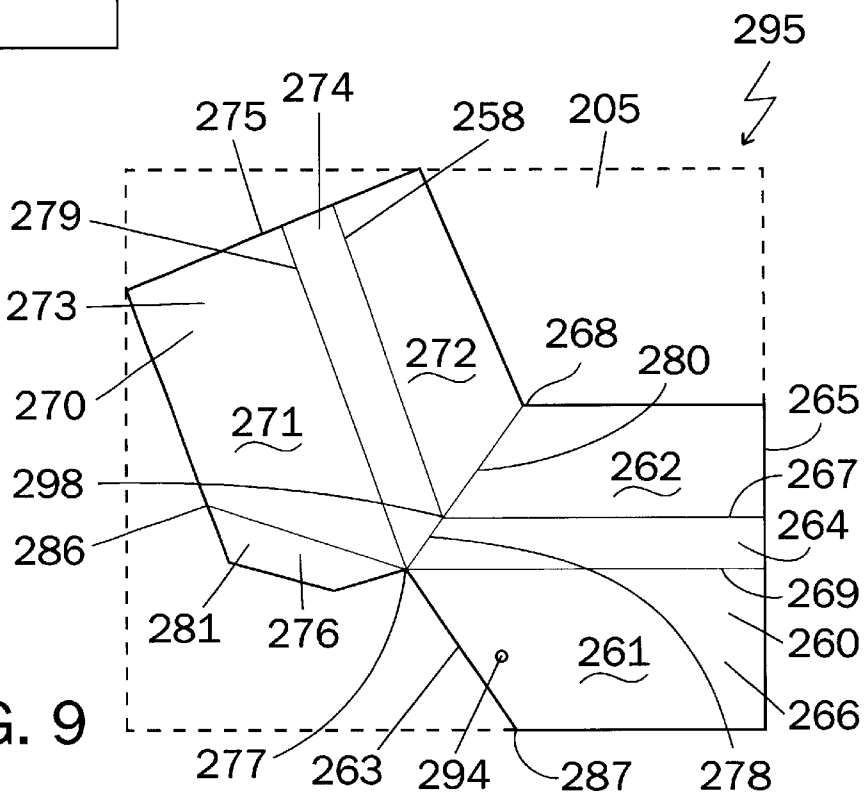
FIG. 9 is a plan view of a single piece hip corner assembly laid out upon a flat sheet of material wherein the single piece hip corner assembly has a continuous drip flange.
Figure 10:
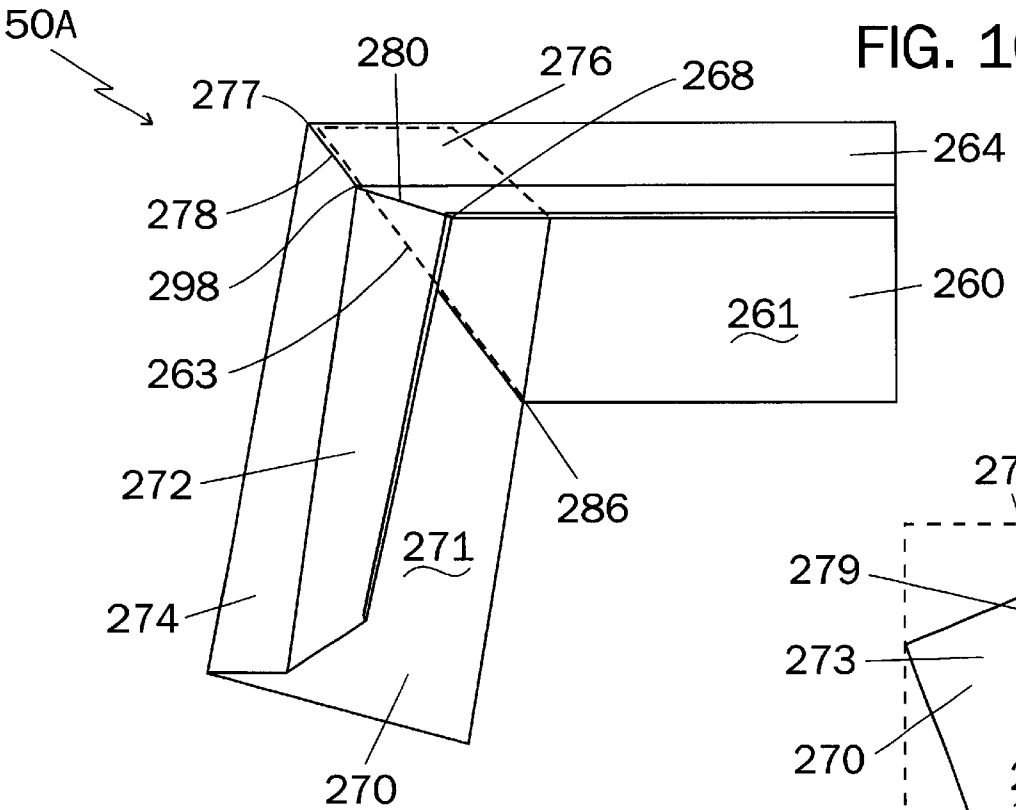
FIG. 10 is an inverted partially perspective view of the single piece hip corner assembly shown with the roof flanges having means retaining same together.
Figure 11:
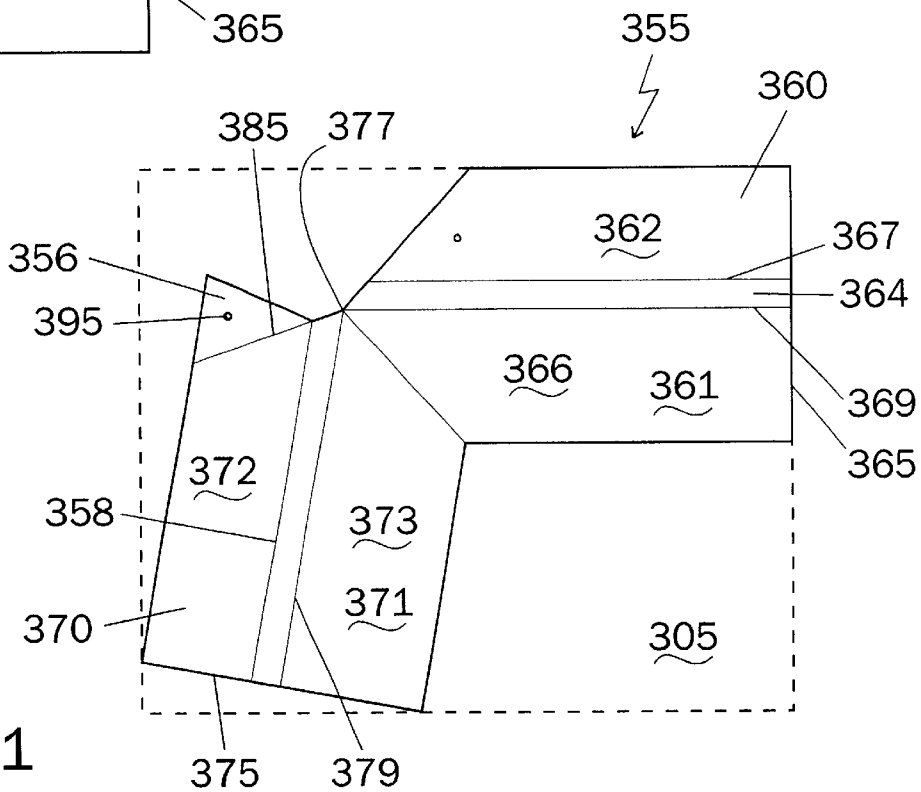
FIG. 11 is a plan view of a single piece hip corner assembly laid out upon a flat sheet of material wherein the single piece hip corner assembly has a continuous roof flange.

Referring now to FIGS. 9–11, the novel hip corner assembly 50A of this invention is first shown in FIG. 9 as being die cut from a flat, straight section of thin material 205 having a right wing 260 and a left wing 270. Right wing 260 comprises a roof flange portion 261, a shingle extension portion 264 and a drip flange portion 262, left wing 270 comprises a roof flange portion 271, a shingle extension portion 274 and a drip flange portion 272, right wing 260 and left wing 270 joined at a drip flange fold line 280 between drip flange portion 262 of right wing 260 and drip flange portion 272 of left wing 270. Right wing 260 has a shingle extension fold line 267 separating drip flange portion 262 of right wing 260 from shingle extension portion 264 of right wing 260, right wing 260 also having a roof flange fold line 269 separating roof flange portion 261 of right wing 260 from shingle extension portion 264. In like manner, left wing 270 has a shingle extension fold line 258 separating drip flange portion 272 of left wing 270 from shingle extension portion 274 thereof left wing 270 having a roof flange fold line 279 separating roof flange portion 271 of left wing 270 from shingle extension portion 274, however, roof flange portion 271 of left wing 270 also has a tab fold line 286 on a joinder end 281 of roof flange portion 271, tab fold line 286 separating a joint tab 276 from roof flange portion 271 of left wing. As will become readily apparent, joint tab 276 is utilized to join roof flange 271 of left wing 270 to roof flange portion 261 of right wing 260 when novel hip corner assembly 50A is assembled for placement on a hip of a roof construction 150.

Novel hip corner 50A has right wing 260 and left wing 270 formed from single sheet of material 205 as shown in FIG. 9 wherein right wing 260 and left wing 270 may also have a drip flange fold line 268 between drip flange portion 262 of right wing 260 and drip flange portion 270 of left wing 270 partially creased when hip corner 50A is formed from single sheet of material 205. Novel hip corner 50A may also have shingle extension fold line 267 of right wing 260, shingle extension fold line 258 of left wing 270, roof flange fold line 269 of right wing 260, roof flange fold line 279 of left wing 270 and tab fold line 286 partially formed as a crease when right wing 260 and left wing 270 are being formed from single sheet of material 205 and thus hip corner 50A is therefore initially formed in a substantially flat form 295. Then hip corner 50A may be folded about drip flange fold line 268 to fit around hip juncture 154 of roof construction 150 when assembled thereto having shingle extensions 264, 274 with roof portions 261, 271 extending outwardly from hip juncture 154. Thereafter, roof portions 271, 261 may be folded in sequence about roof fold lines 279, 269 respectively such that roof portions 271 and 261 over lap decking portions 155 and can then be affixed thereto during construction of roof construction 150.

As hip corner 50A may be formed in a substantially flat manner having fold lines 267, 269, 274, 279 and 286 only partially creased, multiple sheets of hip corner 50A in the substantially flat form 295 shown in FIG. 9 may readily be stacked for shipping wherein each substantially flat form 295 of hip corner 50A may subsequently be folded along fold lines 267, 269, 274, 279 and 286 and assembled into fabricated hip corner 50A at a job site. Of course, hip corner 50A may be folded along fold lines 267, 269, 274, 279 and 286 at manufacture from sheet of material 205 and nested one within the other for shipping wherein each corner assembly 50A may subsequently be removed from the nested stack and fitted to hip juncture 154 and affixed thereto during the construction of roof construction 150.

When novel hip corner 50A is formed from single sheet of material 205, a slit 278 may be formed through the common shingle extension portion between shingle extension portion 264 of right wing 260 and shingle extension portion 274 of left wing 270 in order to facilitate folding of shingle extensions 264 and 274 though it is generally not necessary to provide for slit 278. Where used, slit 278 extends from a juncture 298 between drip flange fold line 267 of right wing 260 and drip flange fold line 258 of left wing 270 to a juncture 277 between roof flange fold line 269 of right wing 270 and roof flange line 279 of left wing 270.

Novel hip corner 50A of FIG. 10 is created from the substantially flat form 295 shown in FIG. 9 by folding the various portions about the aforementioned fold lines. Beginning with bent tab portion 276 of roof portion 271 of left wing 270, bent tab portion 276 is folded upwardly from the plane of paper along tab fold line 286 over roof portion 271 to enable the remaining folds to be completed with roof portion 261 lying flat upon the paper. Next, with roof portion 261 of right wing 260 lying flat on a surface opposite roof engaging surface 266, the remaining portions 262, 264, 271, 272, 274 and 276 of substantially flat form 295 are folded upwardly along roof flange fold line 269 over roof portion 261 until drip flange portion 262 overlies roof portion 261. Substantially flat form 295 is then gripped along shingle extension portion 264 thereby holding shingle extension portion 264 against roof portion 261 and the remaining portions 262, 271, 272, 274 and 276 are folded back away from roof portion 261 along shingle extension fold line 267 until drip flange 262 is substantially perpendicular to roof portion 261 and shingle extension 264 thus forming shingle extension 214 of right wing 260. Roof portion 271 with bent tab portion 276 folded thereagainst and shingle extension portion 274 are then folded along roof flange fold line 279 to overlie drip flange portion 272 of left wing 270. Shingle extension portion 274 is then held flat against roof flange portion 271 and roof portion 271 while shingle extension 274 and bent tab portion 276 are folded back away from drip flange 272 along shingle extension fold line 258 until roof portion 271 is substantially perpendicular to drip flange portion 272. Bent tab portion 276 is then partially folded away from roof flange portion 271 and left wing 270 is folded toward right wing 260 along drip flange fold line 280 until bent tab portion 276 underlies roof flange portion 261 of right wing 260. Bent tab portion 260 may then be affixed to roof flange portion 261 with means for retaining 120 through a hole 294 formed through roof flange portion 261 adjacent cut edge 263. Though hole 294 is generally provided in roof flange portion 261, this hole is not necessary as thin material 205 is readily pierced with nails, screws or staples generally used in assembling drip edge material to roof construction 150. Therefore, it is possible to fit hip corner 50A to a hip juncture of a roof construction folding bent tab portion 276 to under lie roof flange portion 261 of right wing 260 and pierce both roof flange portion 261 and bent tab portion 276 with the aforementioned fasteners affixing hip corner 50A to decking portions 155 at one point and then overlie free ends 265 and 275 with straight sections of drip edge material affixing these straight sections to hip corner 50A with the appropriate fasteners through the straight sections and free ends 265, 275 into the decking portions 155 and roof edge plates 152.

Fabricated hip corner 50B shown in FIG. 11 is similar to hip corner 50A of FIG. 9 wherein hip corner 50B also comprises a right wing 360 and a left wing 370, right wing 360 comprising a roof flange portion 361, a shingle extension portion 364 and a drip flange portion 362, left wing 370 comprising a roof flange portion 371, a shingle extension portion 374 and a drip flange portion 372. Right wing 360 and left wing 370 are joined at a roof flange fold line 359 between roof flange portion 361 of right wing 360 and roof flange portion 371 of left wing 370.

Hip corner 50B in FIG. 11 has a shingle extension fold line 367 separating drip flange portion 362 of right wing 360 from shingle extension portion 364 of right wing 360. Right wing 360 also has a roof flange fold line 369 separating roof flange portion 361 of right wing 360 from shingle extension portion 364 thereof Left wing 370 has a shingle extension fold line 358 separating drip flange portion 372 of left wing 370 from shingle extension portion 374 thereof and also has a roof flange fold line 379 separating roof flange portion 371 of left wing 370 from shingle extension portion 374 thereof. Hip corner 50B has shingle extension fold line 367 of right wing 360, shingle extension fold line 358 of left wing 370, roof flange fold line 364 of right wing 360, roof flange fold line 379 of left wing 370 and joint tab fold line 385 partially formed as a crease when right wing 360 and left wing 370 are being formed from a single sheet of material 305, hip corner 50B also therefore initially formed in a substantially flat form 355. Preferably, hip corner 50B is initially formed from a single sheet of material selected from the group comprising aluminum, titanium, steel, copper, brass, alloys thereof, thermoplastics or composite materials comprising metals and thermoplastics and has roof flange fold line 359 between roof flange portion 361 of right wing 360 and roof flange portion 371 of left wing 370 partially creased during forming. As hip corner 50B may be formed in a substantially flat manner having fold lines 367, 369, 374, 379 and 385 only partially creased, multiple sheets of hip corner 50B in substantially flat form 355 shown in FIG. 11 may readily be stacked for shipping wherein each substantially flat form 355 of hip corner 50B may subsequently be folded along fold lines 367, 369, 374, 379 and 385 and assembled into fabricated hip corner 50B at a job site. Of course, hip corner 50B may be folded along fold lines 367, 369, 374, 379 and 385 at manufacture from sheet of material 305 and nested one within the other for shipping wherein each corner assembly 50B may subsequently be removed from the nested stack and fitted to hip juncture 154 and affixed thereto during the construction of roof construction 150.

Figure 12:
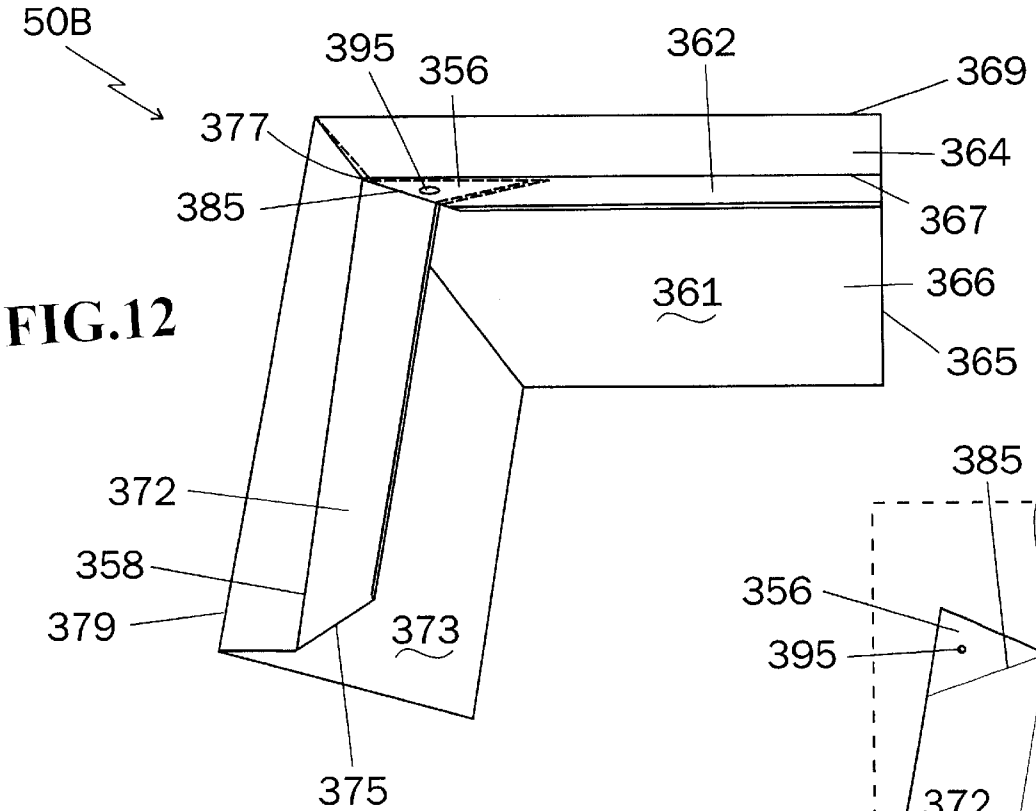
FIG. 12 is an inverted partially perspective view of the single piece hip corner assembly shown with the drip flanges having means retaining same together.

Novel hip corner 50B of FIG. 12 is created from the substantially flat form 355 shown in FIG. 11 by folding the various portions about the aforementioned fold lines. Beginning with roof portion 361 of right wing 360 lying flat on a surface opposite roof engaging surface 366, drip flange portion 362 and shingle extension portion 364 of substantially flat form 295 are folded upwardly along roof flange fold line 369 over roof portion 361 until drip flange portion 362 and shingle extension portion 364 overlie roof portion 361. Shingle extension portion 364 is gripped along the entire length thereof thereby holding shingle extension portion 364 against roof portion 361 and drip flange portion 362 is folded back away from roof portion 361 along shingle extension fold line 367 until drip flange 362 is substantially perpendicular to roof portion 361 and shingle extension 364 thus forming shingle extension 214 of right wing 360. Drip flange portion 372 and shingle extent portion 374 are then folded along roof flange fold line 379 to overlie roof flange portion 371 of left wing 370. Shingle extent portion 374 is then held flat against roof flange portion 371 and drip flange portion 372 and joint tab portion 356 are folded back away from roof flange portion 371 along shingle extension fold line 358 until drip flange portion 372 is substantially perpendicular to roof flange portion 371. Joint tab portion 356 is then partially folded toward roof flange portion 371 at about a ninety degree angle from drip flange portion 372 and left wing 370 is folded toward right wing 360 along roof flange fold line 359 until joint tab portion 356 underlies drip flange portion 362 of right wing 360. Joint tab portion 356 may then be affixed to drip flange portion 362 with means for retaining 120 through a hole 395 formed through joint tab 356. Though hole 395 is generally provided in joint tab 356, hole 395 is not necessary as thin material 305 is readily pierced with nails, screws or staples generally used in assembling drip edge material to roof construction 150. Therefore, it is possible to fit hip corner 50B to a hip juncture 154 of a roof construction folding joint tab 356 to lie behind drip flange portion 362 of right wing 360 and pierce both drip flange portion 362 and joint tab 356 with the aforementioned fasteners affixing hip corner 50B to decking portions 155 at one point and then overlie free ends 365 and 375 with straight sections of drip edge material affixing these straight sections to hip corner 50B with the appropriate fasteners through the straight sections and free ends 365, 375 into the decking portions 155 and roof edge plates 152.

Thus roof construction 150 may alternately use any of hip corner assemblies 50, 50A or 50B or a combination thereof for hip junctures 154 and valley corner assemblies 20 for valley junctures 153 though it is readily apparent that a roof construction 150 would have more hip junctures 154 than valley junctures 153 and therefore the hip corner assemblies 50, 50A and 50B will be greatly beneficial to the construction industry by reducing labor cost in preparing roof construction 150 for application of roofing materials thereupon as well as decrease the incidence of fluid seepage underneath roof edge plate 152.

Hip corner assemblies 50A, 50B are cut from a single sheet of material 205, 305 generally utilized for drip edge material. Such material may be selected from the group comprising aluminum, steel, titanium, copper, brass, alloys thereof thermoplastics or composite materials comprising metals and thermoplastics. The material utilized is placed in a steel rule die or progressive die and the blank shape corresponding to the outlines shown in either FIG. 9 or 11 is cut with the knife edge of the die. In a progressive die, portions 261, 262, 264, 271, 272, 274 and 276 are defined by fold lines 267, 269, 274, 279, 286 wherein these fold lines are partially creased with mating surfaces of the progressive die. In order to form substantially flat form 295 from the outline shown in FIG. 9, drip flange portions 262 and 272 are first captured between mating portions of a progressive die. As the progressive die continues moving, shingle extension portions 264, 274 are folded about shingle extension fold lines 267, 258 respectively until shingle extension portions 264, 274 are substantially perpendicular to drip flange portions 262, 272 respectively. Slit 278 is formed as shingle extension portions 264, 274 are being folded over shingle extension fold lines 267 and 258 thus separating shingle extension portions 264 and 274. At the completion of the stroke of the progressive die, roof flange portions 261, 271 have been formed and are substantially perpendicular to shingle extension portions 264, 274 respectively and a portion of the progressive die moves upwardly forming joint tab 276 about fold line 286. Though a completed hip corner assembly 50A is not yet formed, it is readily apparent that completion of same may be accomplished by placing substantially flat form 295 upon a surface opposite roof engaging surface 266, folding shingle extension 264 flat against surface 266, folding shingle extension 274 flat against roof engaging surface 273, folding left wing 270 toward right wing 260 into the configuration shown in FIG. 10 such that joint tab 276 underlies roof engaging surface 266.

In like manner, hip corner assembly 50B may be made by capturing drip flange portions 362,372 between mating surfaces of a progressive die and shingle extension portions 364, 374 are formed by folding same about drip flange fold lines 367, 358. Drip flange tab 356 is formed in this step by capturing drip flange 356 between mating surfaces of the die and folding same about fold line 385. As the progressive die nears the bottom of the stroke thereof, shingle extension portions 364, 374 are substantially perpendicular to drip flange portions 362,372 as well as roof flange portions 361, 371. Construction of a completed hip corner assembly 50B may then commence by folding shingle extension portions 364, 374 flat against roof engaging surfaces 366, 373 respectively and then folding left wing 370 toward right wing 360 with joint tab 356 underlying roof engaging surface 366. It is readily apparent here that hip corner assemblies 50A or 50B are ready for installation upon hip junctures 154 of roof construction 150.

The above descriptions have shown manufacture of hip corner 50A, 50B using a progressive die wherein the die both cuts and at least partially forms hip corner 50A, 50B during the production of substantially flat form 295, 395 respectively. It is readily apparent that substantially flat form 295, 395 could be cut from a thin sheet of material 205, 305 having fold lines 258, 267, 269, 279, 280 or fold lines 358, 359, 367, 369 and 379 marked and/or scored during or after the cutting of substantially flat form 295, 395, respectively wherein substantially flat form 295 is subsequently folded along fold lines 258, 267, 269, 279, 280 to create hip corner 50A and substantially flat form 395 is folded along fold lines 358, 359, 367, 369 and 379 to create hip corner 50B. Folding of substantially flat form 295 or 395 may proceed immediately after cutting thereof or may be accomplished at the job site utilizing simplified instructions shipped with substantially flat form 295 or 395.

In yet another alternate embodiment, substantially flat form 295, 395 may be formed from flat thermoplastic stock in a mold wherein fold lines 258, 267, 269, 279, 280 or fold lines 358, 359, 367, 369 and 379 are formed as living hinges. Hip corner 50A may then be created by folding substantially flat form 295 of thermoplastic material along living hinge fold lines 258, 267, 269, 279, 280 and securing joint tab 276 to roof flange portion 261. Similarly, hip corner 50B may be assembled by folding substantially flat form 395 along living hinge fold lines 358, 359, 367, 369 and 379 and securing drip tab 356 to drip flange portion 362. In this alternate embodiment, it is contemplated that hip corner 50A, 50B could be assembled at any time after production of substantially flat form 295, 395 respectively even at the time when substantially flat form 295, 395 is assembled to roof construction 150. Drip tab 356 may be secured to drip flange portion 362 by mechanical fasteners as is common in the art or drip flange 356 may be adhesively or cohesively bonded to drip flange portion 362. In like manner, joint tab 276 may be secured to roof flange portion 261 by the aforementioned mechanical fasteners or may also be adhesively or cohesively bonded thereto.

In yet another alternate embodiment, hip corner 50, 50A, 50B may be entirely formed of elastomeric material in an elastomeric molding operation wherein shingle extension 14 is formed as a solid extension extending from roof flange 61, 71 and substantially perpendicular to drip flange 61, 72 and wherein drip flange 61 is integral with drip flange 72 and roof flange 61 is integral with roof flange 71. The dashed lines shown in FIGS. 10 or 12 would not be evident as joint tab 276 or drip tab 256 were molded integral with roof flange 61, 71 and drip flange 62, 72 respectively. In this alternate embodiment, hip corner 50 is ready for mounting upon roof construction 150 without further forming or assembly. It is readily apparent therefore, that in this alternate embodiment, hip corner 50 may be nested with other similar hip corner assemblies 50. Likewise, valley corner 20 may be formed of an elastomeric material in an elastomeric mold and shipped to a construction site ready for assembly to roof construction 150.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A fabricated hip corner for a pitched roof construction, said hip corner comprising a right wing and a left wing, said right wing comprising a roof flange portion, a shingle extension portion and a drip flange portion, said left wing comprising a roof flange portion, a shingle extension portion and a drip flange portion, said right wing and said left wing joined at a drip flange fold line between said drip flange portion of said right wing and said drip flange portion of said left wing.

2. A hip corner as in claim 1 wherein said right wing has a shingle extension fold line separating said drip flange portion of said right wing from said shingle extension portion of said right wing.

3. A hip corner as in claim 1 wherein said right wing has a roof flange fold line separating said roof flange portion of said right wing from said shingle extension portion thereof.

4. A hip corner as in claim 1 wherein said left wing has a tab fold line on a joinder end of said roof flange portion, said tab fold line separating a joint tab from said roof flange portion of said left wing.

5. A hip corner as in claim 1 wherein said left wing has a shingle extension fold line separating said drip flange portion of said left wing from said shingle extension portion thereof.

6. A hip corner as in claim 1 wherein said left wing has a roof flange fold line separating said roof flange portion of said left wing from said shingle extension portion thereof.

7. A hip corner as in claim 1 wherein said right wing has a shingle extension fold line separating said drip flange portion of said right wing from said shingle extension portion of said right wing, said right wing has a roof flange fold line separating said roof flange portion of said right wing from said shingle extension portion thereof, said left wing has a tab fold line on a joinder end of said roof flange portion, said tab fold line separating a joint tab from said roof flange portion of said left wing, said left wing has a shingle extension fold line separating said drip flange portion of said left wing from said shingle extension portion thereof and said left wing has a roof flange fold line separating said roof flange portion of said left wing from said shingle extension portion thereof.

8. A hip corner as in claim 7 wherein said right wing and said left wing are formed from a single sheet of material.

9. A hip corner as in claim 8 wherein said drip flange fold line between said drip flange portion of said right wing and said drip flange portion of said left wing is partially creased when said hip corner is formed from said single sheet of material.

10. A hip corner as in claim 9 wherein said shingle extension fold line of said right wing, said shingle extension fold line of said left wing, said roof flange fold line of said right wing, said roof flange fold line of said left wing and said tab fold line are partially formed as a crease when said right wing and said left wing are being formed from said single sheet of material, said hip corner therefore initially formed in a substantially flat form.

11. A hip corner as in claim 10 wherein multiple sheets comprising said right wing and said left wing are stacked in said substantially flat form thereof for shipping and wherein each said substantially flat form is subsequently folded along said fold lines and assembled into said fabricated hip corner at a job site.

12. A hip corner as in claim 9 wherein said right wing and said left wing have a slit formed through said shingle extension portion between said shingle extension portion of said right wing and said shingle extension portion of said left wing.

13. A fabricated hip corner for a pitched roof construction, said hip corner comprising a right wing and a left wing, said right wing comprising a roof flange portion, a shingle extension portion and a drip flange portion, said left wing comprising a roof flange portion, a shingle extension portion and a drip flange portion, said right wing and said left wing joined at a roof flange fold line between said roof flange portion of said right wing and said roof flange portion of said left wing.

14. A hip corner as in claim 13 wherein said right wing has a shingle extension fold line separating said drip flange portion of said right wing from said shingle extension portion of said right wing, said right wing has a roof flange fold line separating said roof flange portion of said right wing from said shingle extension portion thereof, said left wing has a tab fold line on a joinder end of said drip flange portion, said tab fold line separating a joint tab from said drip flange portion of said left wing, said left wing has a shingle extension fold line separating said drip flange portion of said left wing from said shingle extension portion thereof and said left wing has a roof flange fold line separating said roof flange portion of said left wing from said shingle extension portion thereof.

15. A hip corner as in claim 14 wherein said right wing and said left wing are formed from a single sheet of material.

16. A hip corner as in claim 15 wherein a drip flange fold line between said drip flange portion of said right wing and said drip flange portion of said left wing is partially creased when said hip corner is formed from said single sheet of material.

17. A hip corner as in claim 16 wherein said shingle extension fold line of said right wing, said shingle extension fold line of said left wing, said roof flange fold line of said right wing, said roof flange fold line of said left wing and said tab fold line are partially formed as a crease when said right wing and said left wing are being formed from said single sheet of material, said hip corner therefore initially formed in a substantially flat form.

18. A hip corner as in claim 17 wherein multiple sheets comprising said right wing and said left wing are stacked in said substantially flat form thereof for shipping and wherein each said substantially flat form is subsequently folded along said fold lines and assembled into said fabricated hip corner at a job site.

19. A hip corner as in claim 15 wherein said single sheet of material is selected from the group consisting of aluminum, titanium, steel, copper, brass or thermoplastics.

20. In a drip edge for a pitched roof construction, said pitched roof comprising roof decking, rafters supporting said roof decking, roof edge plates affixed to mitered ends of said rafters and adjacent the open edge of said roof decking, said drip edge overlying at least a portion of said roof edge plates and a portion of said roof decking and being affixed thereto, a roof covering overlying said roof decking and said drip edge, said drip edge comprising elongated straight sections of thin material having a T-shaped cross section and fabricated corner assemblies, the improvement wherein said fabricated corner assemblies comprise hip corner assemblies formed from a single sheet of drip edge material, said hip corner assemblies comprising a right wing and a left wing, said right wing having a roof flange portion, a shingle extension portion and a drip flange portion, said left wing having a roof flange portion, a shingle extension portion and a drip flange portion, said right wing and said left wing having a common drip flange and a common lower portion of said shingle extension portions.

* * * * *